US009277626B2

(12) United States Patent
Matsuura

(10) Patent No.: US 9,277,626 B2
(45) Date of Patent: Mar. 1, 2016

(54) LIGHT SOURCE CONTROL APPARATUS, CONTROL METHOD FOR CONTROLLING THE SAME, AND LIQUID CRYSTAL DISPLAY APPARATUS

(71) Applicant: CANON KABUSHIKI KAISHA, Tokyo (JP)

(72) Inventor: Yasuhiro Matsuura, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 23 days.

(21) Appl. No.: 13/827,107

(22) Filed: Mar. 14, 2013

(65) Prior Publication Data

US 2013/0249958 A1 Sep. 26, 2013

(30) Foreign Application Priority Data

Mar. 22, 2012 (JP) ..... 2012-065484
Jan. 30, 2013 (JP) ..... 2013-015635

(51) Int. Cl.
*G09G 3/36* (2006.01)
*H05B 37/02* (2006.01)
*G09G 3/34* (2006.01)

(52) U.S. Cl.
CPC ..... *H05B 37/0209* (2013.01); *G09G 3/3426* (2013.01); *G09G 3/36* (2013.01); *G09G 2320/064* (2013.01); *G09G 2330/025* (2013.01)

(58) Field of Classification Search
None
See application file for complete search history.

(56) References Cited

U.S. PATENT DOCUMENTS

| | | | | |
|---|---|---|---|---|
| 8,358,263 | B2 * | 1/2013 | Ng et al. | 345/102 |
| 2009/0251071 | A1 * | 10/2009 | Gater | G09G 3/342 315/297 |
| 2011/0169795 | A1 * | 7/2011 | Kondoh et al. | 345/207 |
| 2011/0267375 | A1 * | 11/2011 | Yang et al. | 345/690 |
| 2012/0299979 | A1 * | 11/2012 | Murai et al. | 345/690 |

FOREIGN PATENT DOCUMENTS

| | | |
|---|---|---|
| JP | 2001-312241 | 11/2001 |
| JP | 2010-152174 | 7/2010 |
| WO | 2010/041504 A1 | 4/2010 |
| WO | WO 2011104952 A1 * | 9/2011 |

OTHER PUBLICATIONS

Dec. 2, 2014 Japanese Office Action, issued in Japanese Patent Application No. 2013-015635.

* cited by examiner

*Primary Examiner* — Joseph Haley
(74) *Attorney, Agent, or Firm* — Cowan, Liebowitz & Latman, P.C.

(57) ABSTRACT

Disclosed is a light source control apparatus which controls a plurality of light sources; wherein a luminance can be independently controlled for each of the plurality of light sources by changing a ratio between a turned-on period and a turned-off period; the light source control apparatus comprising a determining unit configured to determine the respective luminances of the plurality of light sources and to determine, as a light source driving condition, a length of the turned-on period of each of the plurality of light sources and a turn-on reference timing as a start timing of the turned-on period; a correcting unit configured to perform correction for the light source driving condition to lower the luminance(s) of at least one of the plurality of light sources so that an electric power consumption is not more than a threshold value at all of the turn-on reference timings.

24 Claims, 25 Drawing Sheets

LIGHT SOURCE UNIT 10

| | COLUMN A | COLUMN B | COLUMN C | COLUMN D |
|---|---|---|---|---|
| ROW 1 | LIGHT SOURCE BLOCK 1A | LIGHT SOURCE BLOCK 1B | LIGHT SOURCE BLOCK 1C | LIGHT SOURCE BLOCK 1D |
| ROW 2 | LIGHT SOURCE BLOCK 2A | LIGHT SOURCE BLOCK 2B | LIGHT SOURCE BLOCK 2C | LIGHT SOURCE BLOCK 2D |
| ROW 3 | LIGHT SOURCE BLOCK 3A | LIGHT SOURCE BLOCK 3B | LIGHT SOURCE BLOCK 3C | LIGHT SOURCE BLOCK 3D |

*Fig.1C*

| LIGHT SOURCE NUMBER | LUMINANCE OF LIGHT SOURCE n = PWM VALUE (MAXIMUM VALUE IS 4096) | |
|---|---|---|
| | FIRST FRAME | SECOND FRAME |
| LIGHT SOURCE 1 | 3650 | 3650 |
| LIGHT SOURCE 2 | 1960 | 1960 |
| LIGHT SOURCE 3 | 2300 | 2300 |
| LIGHT SOURCE 4 | 2600 | 2600 |

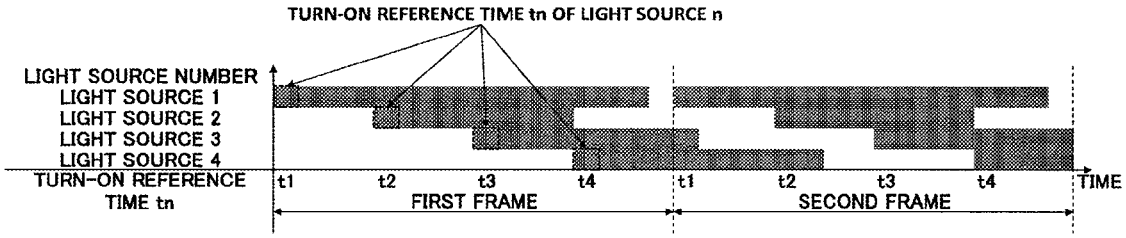

| LIGHT SOURCE NUMBER | LUMINANCE OF LIGHT SOURCE n = PWM VALUE (MAXIMUM VALUE IS 4096) | |
|---|---|---|
| | FIRST FRAME | SECOND FRAME |
| LIGHT SOURCE 1 | 3650 | 3650 |
| LIGHT SOURCE 2 | 1960 | 1960 |
| LIGHT SOURCE 3 | 2300 | 2300 |
| LIGHT SOURCE 4 | 2600 | 2600 |

*Fig. 4A*

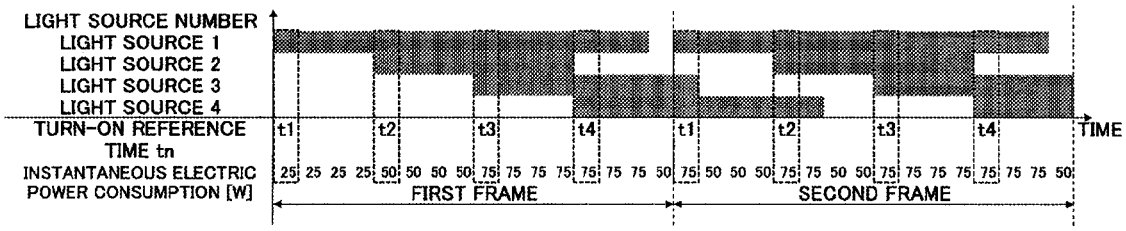

| LIGHT SOURCE NUMBER | LUMINANCE OF LIGHT SOURCE n = PWM VALUE (MAXIMUM VALUE IS 4096) | |
|---|---|---|
| | FIRST FRAME | SECOND FRAME |
| LIGHT SOURCE 1 | 3650 | 3650 |
| LIGHT SOURCE 2 | 1960 | 1960 |
| LIGHT SOURCE 3 | 2300 | 2300 |
| LIGHT SOURCE 4 | 2600 | 2600 |

*Fig. 4B*

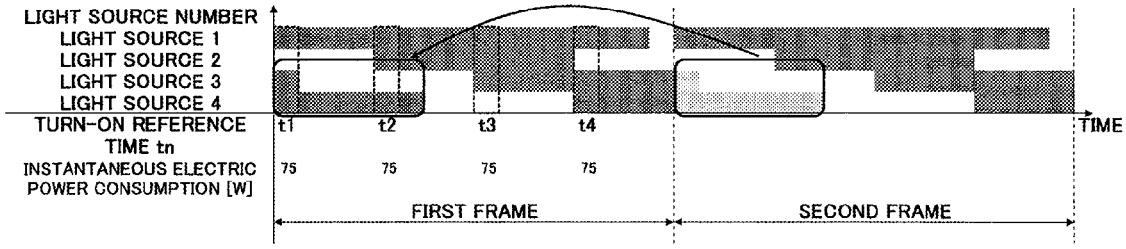

| LIGHT SOURCE NUMBER | LUMINANCE OF LIGHT SOURCE n = PWM VALUE (MAXIMUM VALUE IS 4096) | |
|---|---|---|
| | FIRST FRAME | SECOND FRAME |
| LIGHT SOURCE 1 | 3650 | 3650 |
| LIGHT SOURCE 2 | 1960 | 1960 |
| LIGHT SOURCE 3 | 2300 | 2300 |
| LIGHT SOURCE 4 | 2600 | 2600 |

*Fig. 4C*

| LIGHT SOURCE NUMBER | LUMINANCE OF LIGHT SOURCE n (PWM VALUE) = Ln_on = L_all − Ln_off | PWM VALUE FROM TURN-ON REFERENCE TIME OF LIGHT SOURCE n TO TURN-ON REFERENCE TIME t1 | CORRECTION COEFFICIENT TO TURN OFF LIGHT SOURCE n AT TURN-ON REFERENCE TIME t1 |
|---|---|---|---|
| | FIRST FRAME | Ln_t1 | Cn_t1 = Ln_t1 / Ln_on |
| LIGHT SOURCE 1 | 3650 | – | – |
| LIGHT SOURCE 2 | 1960 | – | – |
| LIGHT SOURCE 3 | 2300 | L3_t1 = 2048 | 0.890 |
| LIGHT SOURCE 4 | 2600 | L4_t1 = 1024 | 0.394 |

| LIGHT SOURCE NUMBER | LUMINANCE OF LIGHT SOURCE n (PWM VALUE) = Ln_on = L_all − Ln_off | PWM VALUE FROM TURN-ON REFERENCE TIME OF LIGHT SOURCE n TO TURN-ON REFERENCE TIME t2 | CORRECTION COEFFICIENT TO TURN OFF LIGHT SOURCE n AT TURN-ON REFERENCE TIME t2 |
|---|---|---|---|
| | FIRST FRAME | Ln_t2 | Cn_t2 = Ln_t2 / Ln_on |
| LIGHT SOURCE 1 | 3650 | L1_t2 = 1024 | 0.281 |
| LIGHT SOURCE 2 | 1960 | – | – |
| LIGHT SOURCE 3 | 2300 | – | – |
| LIGHT SOURCE 4 | 2600 | L4_t2 = 2048 | 0.788 |

| LIGHT SOURCE NUMBER | LUMINANCE OF LIGHT SOURCE n (PWM VALUE) = Ln_on = L_all - Ln_off | PWM VALUE FROM TURN-ON REFERENCE TIME OF LIGHT SOURCE n TO TURN-ON REFERENCE TIME t3 | CORRECTION COEFFICIENT TO TURN OFF LIGHT SOURCE n AT TURN-ON REFERENCE TIME t3 |
|---|---|---|---|
| | FIRST FRAME | Ln_t3 | Cn_t3 = Ln_t3 / Ln_on |
| LIGHT SOURCE 1 | 3650 | L1_t3 = 2048 | 0.561 |
| LIGHT SOURCE 2 | 1960 | L2_t3 = 1024 | 0.522 |
| LIGHT SOURCE 3 | 2300 | - | - |
| LIGHT SOURCE 4 | 2600 | - | - |

| LIGHT SOURCE NUMBER | LUMINANCE OF LIGHT SOURCE n (PWM VALUE) = Ln_on = L_all − Ln_off | PWM VALUE FROM TURN-ON REFERENCE TIME OF LIGHT SOURCE n TO TURN-ON REFERENCE TIME t4 | CORRECTION COEFFICIENT TO TURN OFF LIGHT SOURCE n AT TURN-ON REFERENCE TIME t4 |
|---|---|---|---|
| | FIRST FRAME | Ln_t4 | Cn_t4 = Ln_t4 / Ln_on |
| LIGHT SOURCE 1 | 3650 | L1_t4 = 3072 | **0.842** |
| LIGHT SOURCE 2 | 1960 | – | – |
| LIGHT SOURCE 3 | 2300 | L3_t4 = 1024 | 0.445 |
| LIGHT SOURCE 4 | 2600 | – | – |

| LIGHT SOURCE NUMBER | LUMINANCE OF LIGHT SOURCE n (PWM VALUE) = Ln_on = L_all - Ln_off | CORRECTION COEFFICIENT TO TURN OFF LIGHT SOURCE n AT TURN-ON REFERENCE TIME t1 | CORRECTION COEFFICIENT TO TURN OFF LIGHT SOURCE n AT TURN-ON REFERENCE TIME t2 | CORRECTION COEFFICIENT TO TURN OFF LIGHT SOURCE n AT TURN-ON REFERENCE TIME t3 | CORRECTION COEFFICIENT TO TURN OFF LIGHT SOURCE n AT TURN-ON REFERENCE TIME t4 | LUMINANCE OF LIGHT SOURCE n AFTER CORRECTION = Ln_on x Cn_tn |
|---|---|---|---|---|---|---|
| | FIRST FRAME | Cn_t1 = Ln_t1 / Ln_on | Cn_t2 = Ln_t2 / Ln_on | Cn_t3 = Ln_t3 / Ln_on | Cn_t4 = Ln_t4 / Ln_on | Ln_on x 0.561 |
| LIGHT SOURCE 1 | 3650 | - | ~~0.281~~ | **0.561** | 0.842 | 2048 |
| LIGHT SOURCE 2 | 1960 | - | - | ~~0.522~~ | - | 1100 |
| LIGHT SOURCE 3 | 2300 | 0.890 | - | - | ~~0.445~~ | 1291 |
| LIGHT SOURCE 4 | 2600 | ~~0.394~~ | 0.788 | - | - | 1459 |

*Fig.9*

| LIGHT SOURCE NUMBER | LUMINANCE OF LIGHT SOURCE n = PWM VALUE (MAXIMUM VALUE IS 4096) | |
|---|---|---|
| | FIRST FRAME | SECOND FRAME |
| LIGHT SOURCE 1 | 2048 | 2048 |
| LIGHT SOURCE 2 | 1100 | 1100 |
| LIGHT SOURCE 3 | 1291 | 1291 |
| LIGHT SOURCE 4 | 1459 | 1459 |

| LIGHT SOURCE NUMBER | LUMINANCE OF LIGHT SOURCE n (PWM VALUE) = Ln_on = L_all − Ln_off | PWM VALUE FROM TURN-ON REFERENCE TIME OF LIGHT SOURCE n TO TURN-ON REFERENCE TIME t1 | CORRECTION COEFFICIENT TO TURN OFF LIGHT SOURCE n AT TURN-ON REFERENCE TIME t1 |
|---|---|---|---|
| | FIRST FRAME | Ln_t1 | Cn_t1 = Ln_t1 / Ln_on |
| LIGHT SOURCE 1 | 3650 | – | – |
| LIGHT SOURCE 2 | 1960 | – | – |
| LIGHT SOURCE 3 | 2300 | L3_t1 = 2048 | 0.890 |
| LIGHT SOURCE 4 | 2600 | L4_t1 = 1024 | 0.394 |

| LIGHT SOURCE NUMBER | LUMINANCE OF LIGHT SOURCE n (PWM VALUE) = Ln_on = L_all − Ln_off | PWM VALUE FROM TURN-ON REFERENCE TIME OF LIGHT SOURCE n TO TURN-ON REFERENCE TIME t2 | CORRECTION COEFFICIENT TO TURN OFF LIGHT SOURCE n AT TURN-ON REFERENCE TIME t2 |
|---|---|---|---|
| | FIRST FRAME | Ln_t2 | Cn_t2 = Ln_t2 / Ln_on |
| LIGHT SOURCE 1 | 3650 | L1_t2 = 1024 | 0.281 |
| LIGHT SOURCE 2 | 1960 | - | - |
| LIGHT SOURCE 3 | 2300 | - | - |
| LIGHT SOURCE 4 | 2600 | L4_t2 = 2048 | 0.788 |

| LIGHT SOURCE NUMBER | LUMINANCE OF LIGHT SOURCE n (PWM VALUE) = Ln_on = L_all − Ln_off | PWM VALUE FROM TURN-ON REFERENCE TIME OF LIGHT SOURCE n TO TURN-ON REFERENCE TIME t3 | CORRECTION COEFFICIENT TO TURN OFF LIGHT SOURCE n AT TURN-ON REFERENCE TIME t3 |
|---|---|---|---|
| | FIRST FRAME | Ln_t3 | Cn_t3 = Ln_t3 / Ln_on |
| LIGHT SOURCE 1 | 3650 | L1_t3 = 2048 | 0.561 |
| LIGHT SOURCE 2 | 1960 | L2_t3 = 1024 | 0.522 |
| LIGHT SOURCE 3 | 2300 | – | – |
| LIGHT SOURCE 4 | 2600 | – | – |

| LIGHT SOURCE NUMBER | LUMINANCE OF LIGHT SOURCE n (PWM VALUE) = Ln_on = L_all − Ln_off | PWM VALUE FROM TURN-ON REFERENCE TIME OF LIGHT SOURCE n TO TURN-ON REFERENCE TIME t4 | CORRECTION COEFFICIENT TO TURN OFF LIGHT SOURCE n AT TURN-ON REFERENCE TIME t4 |
|---|---|---|---|
| | FIRST FRAME | Ln_t4 | Cn_t4 = Ln_t4 / Ln_on |
| LIGHT SOURCE 1 | 3650 | ~~L1_t4 = 3072~~ | ~~0.842~~ |
| LIGHT SOURCE 2 | 1960 | – | – |
| LIGHT SOURCE 3 | 2300 | L3_t4 = 1024 | 0.445 |
| LIGHT SOURCE 4 | 2600 | – | – |

| LIGHT SOURCE NUMBER | LUMINANCE OF LIGHT SOURCE n (PWM VALUE) = Ln_on = L_all - Ln_off | CORRECTION COEFFICIENT TO TURN OFF LIGHT SOURCE n AT TURN-ON REFERENCE TIME t1 | CORRECTION COEFFICIENT TO TURN OFF LIGHT SOURCE n AT TURN-ON REFERENCE TIME t2 | CORRECTION COEFFICIENT TO TURN OFF LIGHT SOURCE n AT TURN-ON REFERENCE TIME t3 | CORRECTION COEFFICIENT TO TURN OFF LIGHT SOURCE n AT TURN-ON REFERENCE TIME t4 | LUMINANCE OF LIGHT SOURCE n AFTER CORRECTION = Ln_on x Cn_tn |
|---|---|---|---|---|---|---|
| | FIRST FRAME | Cn_t1 = Ln_t1 / Ln_on | Cn_t2 = Ln_t2 / Ln_on | Cn_t3 = Ln_t3 / Ln_on | Cn_t4 = Ln_t4 / Ln_on | Ln_on x 0.445 |
| LIGHT SOURCE 1 | 3650 | - | ~~0.281~~ | ~~0.561~~ | ~~0.842~~ | 3650 |
| LIGHT SOURCE 2 | 1960 | - | - | 0.522 | - | 873 |
| LIGHT SOURCE 3 | 2300 | 0.890 | - | - | 0.445 | 1024 |
| LIGHT SOURCE 4 | 2600 | ~~0.394~~ | 0.788 | - | - | 1158 |

*Fig.15*

| LIGHT SOURCE NUMBER | LUMINANCE OF LIGHT SOURCE n = PWM VALUE (MAXIMUM VALUE IS 4096) | |
|---|---|---|
| | FIRST FRAME | SECOND FRAME |
| LIGHT SOURCE 1 | 3650 | 3650 |
| LIGHT SOURCE 2 | 873 | 873 |
| LIGHT SOURCE 3 | 1024 | 1024 |
| LIGHT SOURCE 4 | 1158 | 1158 |

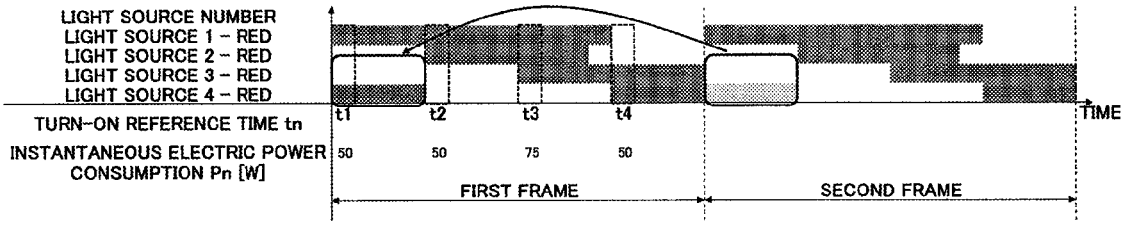

| LIGHT SOURCE NUMBER | LUMINANCE OF LIGHT SOURCE n – RED = PWM VALUE (MAXIMUM VALUE IS 4096) | |
|---|---|---|
| | FIRST FRAME | SECOND FRAME |
| LIGHT SOURCE 1 – RED | 3014 | 3014 |
| LIGHT SOURCE 2 – RED | 1618 | 1618 |
| LIGHT SOURCE 3 – RED | 1900 | 1900 |
| LIGHT SOURCE 4 – RED | 2146 | 2146 |

*Fig. 17A*

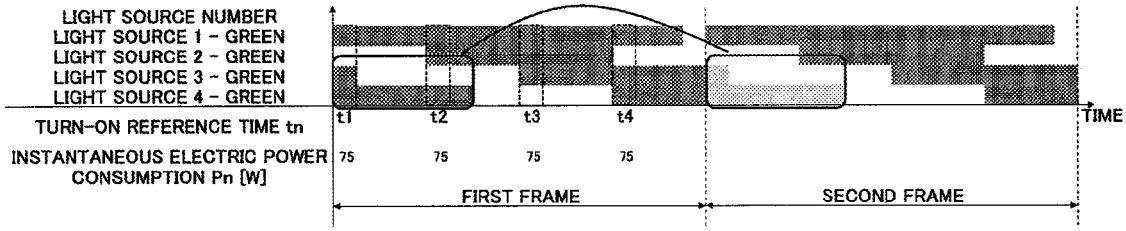

| LIGHT SOURCE NUMBER | LUMINANCE OF LIGHT SOURCE n – GREEN = PWM VALUE (MAXIMUM VALUE IS 4096) | |
|---|---|---|
| | FIRST FRAME | SECOND FRAME |
| LIGHT SOURCE 1 – GREEN | 3650 | 3650 |
| LIGHT SOURCE 2 – GREEN | 1960 | 1960 |
| LIGHT SOURCE 3 – GREEN | 2300 | 2300 |
| LIGHT SOURCE 4 – GREEN | 2600 | 2600 |

*Fig. 17B*

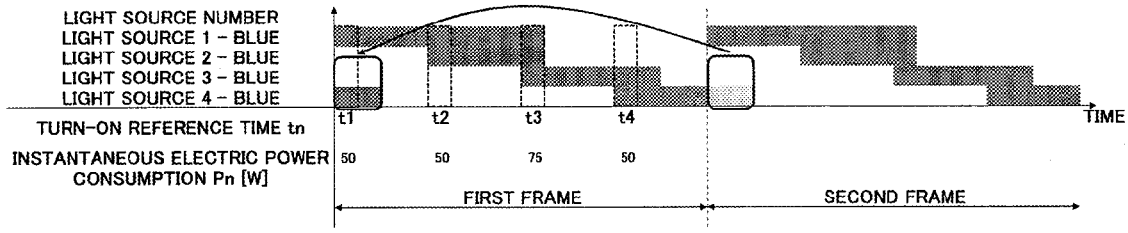

| LIGHT SOURCE NUMBER | LUMINANCE OF LIGHT SOURCE n – BLUE = PWM VALUE (MAXIMUM VALUE IS 4096) | |
|---|---|---|
| | FIRST FRAME | SECOND FRAME |
| LIGHT SOURCE 1 – BLUE | 2400 | 2400 |
| LIGHT SOURCE 2 – BLUE | 1288 | 1288 |
| LIGHT SOURCE 3 – BLUE | 1512 | 1512 |
| LIGHT SOURCE 4 – BLUE | 1708 | 1708 |

*Fig. 17C*

| LIGHT SOURCE NUMBER | LUMINANCE OF LIGHT SOURCE n (PWM VALUE) = Ln_on = L_all - Ln_off | CORRECTION COEFFICIENT TO TURN OFF LIGHT SOURCE n AT TURN-ON REFERENCE TIME t1 | CORRECTION COEFFICIENT TO TURN OFF LIGHT SOURCE n AT TURN-ON REFERENCE TIME t2 | CORRECTION COEFFICIENT TO TURN OFF LIGHT SOURCE n AT TURN-ON REFERENCE TIME t3 | CORRECTION COEFFICIENT TO TURN OFF LIGHT SOURCE n AT TURN-ON REFERENCE TIME t4 | MINIMUM VALUE OF CORRECTION COEFFICIENT | LUMINANCE OF LIGHT SOURCE n AFTER CORRECTION = Ln_on x Cn_tn |
|---|---|---|---|---|---|---|---|
| | FIRST FRAME | Cn_t1 = Ln_t1 / Ln_on | Cn_t2 = Ln_t2 / Ln_on | Cn_t3 = Ln_t3 / Ln_on | Cn_t4 = Ln_t4 / Ln_on | | Ln_on x 0.561 |
| LIGHT SOURCE 1 - RED | 3014 | - | - | 0.679 | - | 0.679 | 1691 |
| LIGHT SOURCE 2 - RED | 1618 | - | - | ~~0.633~~ | - | | 908 |
| LIGHT SOURCE 3 - RED | 1900 | - | - | - | - | | 1066 |
| LIGHT SOURCE 4 - RED | 2146 | - | - | - | - | | 1204 |
| LIGHT SOURCE 1 - GREEN | 3650 | - | ~~0.281~~ | 0.561 | 0.842 | 0.561 | 2048 |
| LIGHT SOURCE 2 - GREEN | 1960 | - | - | ~~0.522~~ | - | | 1100 |
| LIGHT SOURCE 3 - GREEN | 2300 | 0.890 | - | - | ~~0.445~~ | | 1291 |
| LIGHT SOURCE 4 - GREEN | 2600 | ~~0.394~~ | 0.788 | - | - | | 1459 |
| LIGHT SOURCE 1 - BLUE | 2400 | - | - | ~~0.853~~ | - | 0.994 | 1347 |
| LIGHT SOURCE 2 - BLUE | 1288 | - | - | 0.994 | - | | 723 |
| LIGHT SOURCE 3 - BLUE | 1512 | - | - | - | - | | 849 |
| LIGHT SOURCE 4 - BLUE | 1708 | - | - | - | - | | 959 |

*Fig.18*

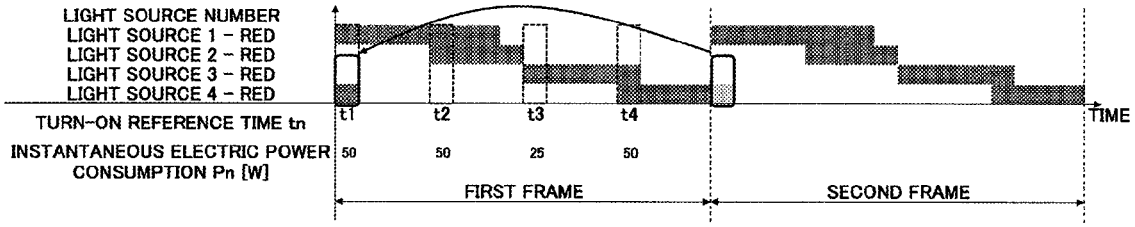

| LIGHT SOURCE NUMBER | LUMINANCE OF LIGHT SOURCE n – RED = PWM VALUE (MAXIMUM VALUE IS 4096) | |
|---|---|---|
| | FIRST FRAME | SECOND FRAME |
| LIGHT SOURCE 1 – RED | 1691 | 1691 |
| LIGHT SOURCE 2 – RED | 908 | 908 |
| LIGHT SOURCE 3 – RED | 1066 | 1066 |
| LIGHT SOURCE 4 – RED | 1204 | 1204 |

*Fig.19A*

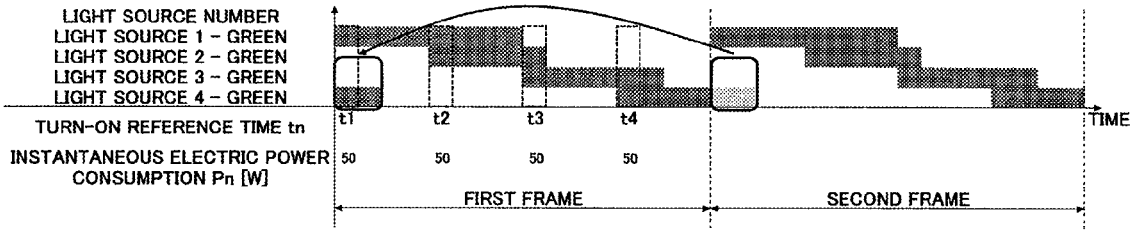

| LIGHT SOURCE NUMBER | LUMINANCE OF LIGHT SOURCE n – GREEN = PWM VALUE (MAXIMUM VALUE IS 4096) | |
|---|---|---|
| | FIRST FRAME | SECOND FRAME |
| LIGHT SOURCE 1 – GREEN | 2048 | 2048 |
| LIGHT SOURCE 2 – GREEN | 1100 | 1100 |
| LIGHT SOURCE 3 – GREEN | 1291 | 1291 |
| LIGHT SOURCE 4 – GREEN | 1459 | 1459 |

*Fig.19B*

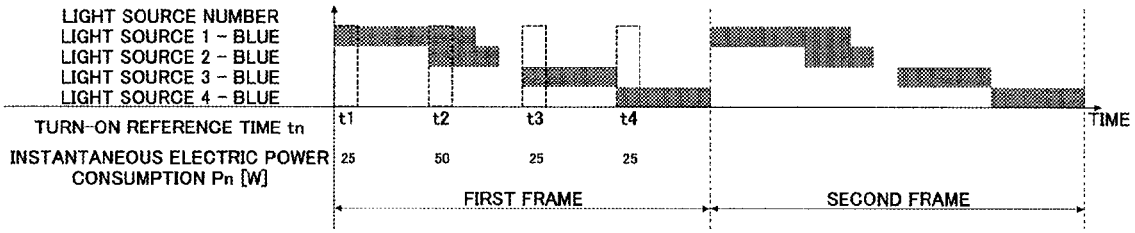

| LIGHT SOURCE NUMBER | LUMINANCE OF LIGHT SOURCE n – BLUE = PWM VALUE (MAXIMUM VALUE IS 4096) | |
|---|---|---|
| | FIRST FRAME | SECOND FRAME |
| LIGHT SOURCE 1 – BLUE | 1347 | 1347 |
| LIGHT SOURCE 2 – BLUE | 723 | 723 |
| LIGHT SOURCE 3 – BLUE | 849 | 849 |
| LIGHT SOURCE 4 – BLUE | 959 | 959 |

*Fig.19C*

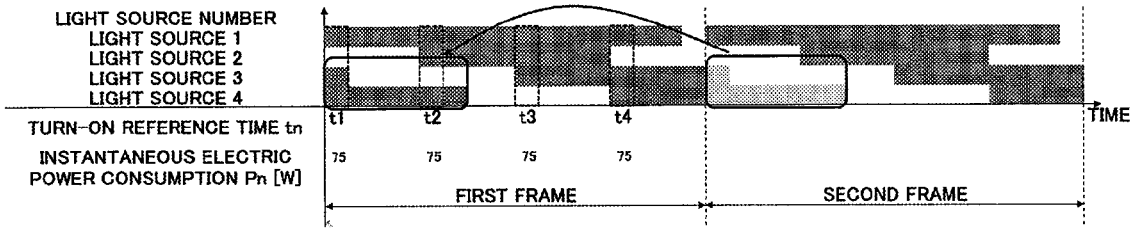

| LIGHT SOURCE NUMBER | LUMINANCE OF LIGHT SOURCE n = PWM VALUE (MAXIMUM VALUE IS 4096) | |
|---|---|---|
| | FIRST FRAME | SECOND FRAME |
| LIGHT SOURCE 1 | 3650 | 3650 |
| LIGHT SOURCE 2 | 1960 | 1960 |
| LIGHT SOURCE 3 | 2300 | 2300 |
| LIGHT SOURCE 4 | 2600 | 2600 |

LUMINANCE CORRECTION COEFFICIENT = Pmax/Plimit = 50/75 = 0.667

*Fig.20A*

CORRECTION CALCULATION PERFORMED FOR FIRST TIME

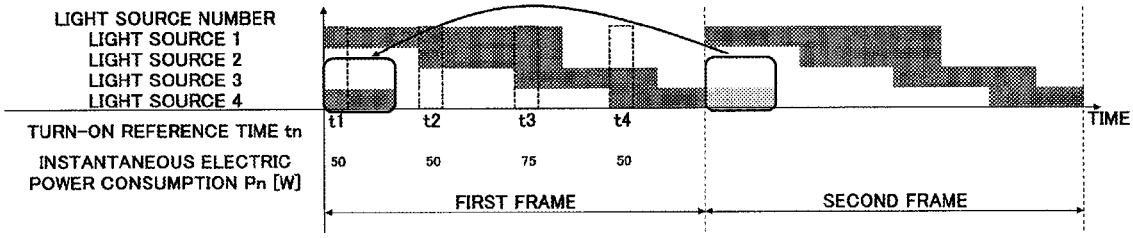

| LIGHT SOURCE NUMBER | LUMINANCE OF LIGHT SOURCE n = CORRECTION COEFFICIENT C x PWM VALUE = 0.667 x PWM VALUE | |
|---|---|---|
| | FIRST FRAME | SECOND FRAME |
| LIGHT SOURCE 1 | 2434 | 2434 |
| LIGHT SOURCE 2 | 1306 | 1306 |
| LIGHT SOURCE 3 | 1534 | 1534 |
| LIGHT SOURCE 4 | 1734 | 1734 |

LUMINANCE CORRECTION COEFFICIENT = Pmax/Plimit = 50/75 = 0.667

*Fig.20B*

CORRECTION CALCULATION PERFORMED FOR SECOND TIME

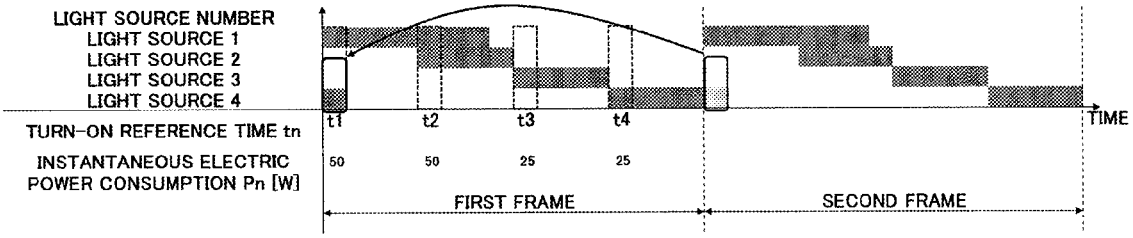

| LIGHT SOURCE NUMBER | LUMINANCE OF LIGHT SOURCE n = CORRECTION COEFFICIENT C x PWM VALUE = 0.667 x PWM VALUE | |
|---|---|---|
| | FIRST FRAME | SECOND FRAME |
| LIGHT SOURCE 1 | 1622 | 1622 |
| LIGHT SOURCE 2 | 870 | 870 |
| LIGHT SOURCE 3 | 1022 | 1022 |
| LIGHT SOURCE 4 | 1156 | 1156 |

*Fig.20C*

LIGHT SOURCE CONTROL APPARATUS, CONTROL METHOD FOR CONTROLLING THE SAME, AND LIQUID CRYSTAL DISPLAY APPARATUS

BACKGROUND OF THE INVENTION

1. Field of the Invention

The present invention relates to a light source control apparatus, a control method for controlling the same, and a liquid crystal display apparatus.

2. Description of the Related Art

A method is known, in which the luminance of the light source of a backlight is variably controlled partially or for the entire screen in accordance with the contents of an input video signal (picture signal) in order to expand the contrast of a liquid crystal display. A backlight control method, in which the light source luminance provided at a position corresponding to each of a plurality of divided areas set in a display area of a display panel is variably controlled depending on a statistical amount (gradation value) of an image to be displayed on the divided area, is generally referred to as "local dimming". The control method for the local dimming is roughly classified into a control method in which only the light source luminance of the dark area is lowered, and a control method in which the light source luminance of the dark area is lowered and the light source luminance of the bright area is raised depending on the amount of decrease in the light source luminance of the dark area. In this context, when the light source luminance of the dark area is lowered and the light source luminance of the bright area is raised as in the latter control method, the electric power consumption is also temporally fluctuated increasingly or decreasingly with respect to the average value in accordance with the dynamic change of the light source luminance. Therefore, in view of the protection of a power source circuit which supplies the electric power to the light source of the backlight, a technique has been suggested, in which the light source luminance is controlled while making the restriction or limitation so that the electric power consumption of the light source does not exceed the electric power amount capable of being supplied by the power source.

For example, JP2010-152174A suggests that a luminance correction coefficient, which allows an average light source luminance of the entire screen to be not more than a certain prescribed value, is calculated for each of frames, and the luminance correction coefficient is used to correct the light source luminance of the entire backlight. According to JP2010-152174A, the electric power consumption can be suppressed in temporal average in relation to 1 frame.

On the other hand, JP2001-312241A suggests such a technique that a plurality of light sources for constructing a backlight are successively turned ON every certain delay times, and thus the instantaneous concentration of the electric power load is suppressed. According to JP2001-312241A, the plurality of light sources are successively turned ON every certain delay times, and hence the electric power load can be dispersed within a period of 1 frame when the luminances of the respective light sources are identical with each other.

SUMMARY OF THE INVENTION

However, when the luminances of the plurality of light sources are variably controlled independently in accordance with the local dimming, the electric power consumption of the backlight instantaneously becomes large in the period of 1 frame, even when the plurality of light sources are successively turned ON every certain delay times as performed in JP2001-312241A.

In view of the above, the present invention provides a light source control apparatus which makes it possible to suppress the increase in the instantaneous electric power consumption of a backlight subjected to the local dimming control.

A first aspect of the present invention resides in a light source control apparatus which controls a plurality of light sources, wherein:

a luminance can be independently controlled for each of the plurality of light sources by changing a ratio between a turned-on period and a turned-off period, the light source control apparatus comprising:

a power source which supplies an electric power to the plurality of light sources;

a determining unit configured to determine the respective luminances of the plurality of light sources in accordance with an inputted image signal and to determine, as a light source driving condition, a length of the turned-on period of each of the plurality of light sources and a turn-on reference timing as a start timing of the turned-on period, on the basis of the concerning luminance;

a calculating unit configured to calculate an electric power consumption of the power source at the turn-on reference timing of each of the plurality of light sources on the basis of the light source driving condition; and a correcting unit configured to perform correction for the light source driving condition to lower the luminance or luminances of at least one or some of the plurality of light sources so that the electric power consumption is not more than a threshold value at all of the turn-on reference timings if a maximum value of the electric power consumption calculated by the calculating unit exceeds the predetermined threshold value.

A second aspect of the present invention resides in a control method for controlling a light source control apparatus which controls a plurality of light sources, wherein:

a luminance can be independently controlled for each of the plurality of light sources by changing a ratio between a turned-on period and a turned-off period, the control method for controlling the light source control apparatus comprising:

a determining step of determining the respective luminances of the plurality of light sources in accordance with an inputted image signal and determining, as a light source driving condition, a length of the turned-on period of each of the plurality of light sources and a turn-on reference timing as a start timing of the turned-on period, on the basis of the concerning luminance;

a calculating step of calculating an electric power consumption of a power source which supplies an electric power to the plurality of light sources, at the turn-on reference timing of each of the plurality of light sources on the basis of the light source driving condition; and a correcting step of performing correction for the light source driving condition to lower the luminance or luminances of at least one or some of the plurality of light sources so that the electric power consumption is not more than a threshold value at all of the turn-on reference timings if a maximum value of the electric power consumption calculated in the calculating step exceeds the predetermined threshold value.

According to the present invention, the light source control apparatus is provided, which makes it possible to suppress the increase in the instantaneous electric power consumption of a backlight subjected to the local dimming control.

Further features of the present invention will become apparent from the following description of exemplary embodiments with reference to the attached drawings.

BRIEF DESCRIPTION OF THE DRAWINGS

FIG. 1B shows an arrangement of a light source block and FIG. 1C shows another arrangement of a light source block.

FIGS. 4A, 4B and 4C show relationships between turn-on reference timings and instantaneous electric power consumptions of the respective light sources in the first embodiment.

FIG. 9 shows a correction coefficient selecting method for each of the light sources in the first embodiment.

FIG. 15 shows a correction coefficient selecting method for each of the light sources in the second embodiment.

FIGS. 17A, 17B, and 17C show driving conditions and instantaneous electric power consumption values for light sources of respective colors according to a third embodiment.

FIG. 18 shows a correction coefficient selecting method for each of the light sources in the third embodiment.

FIGS. 19A, 19B, and 19C show driving conditions and instantaneous electric power consumption values after the correction for the light sources of the respective colors in the third embodiment.

FIGS. 20A, 20B, and 20C show a correction coefficient calculating method for each of light sources according to a fourth embodiment.

DESCRIPTION OF THE EMBODIMENTS

First Embodiment

Figure 1A:
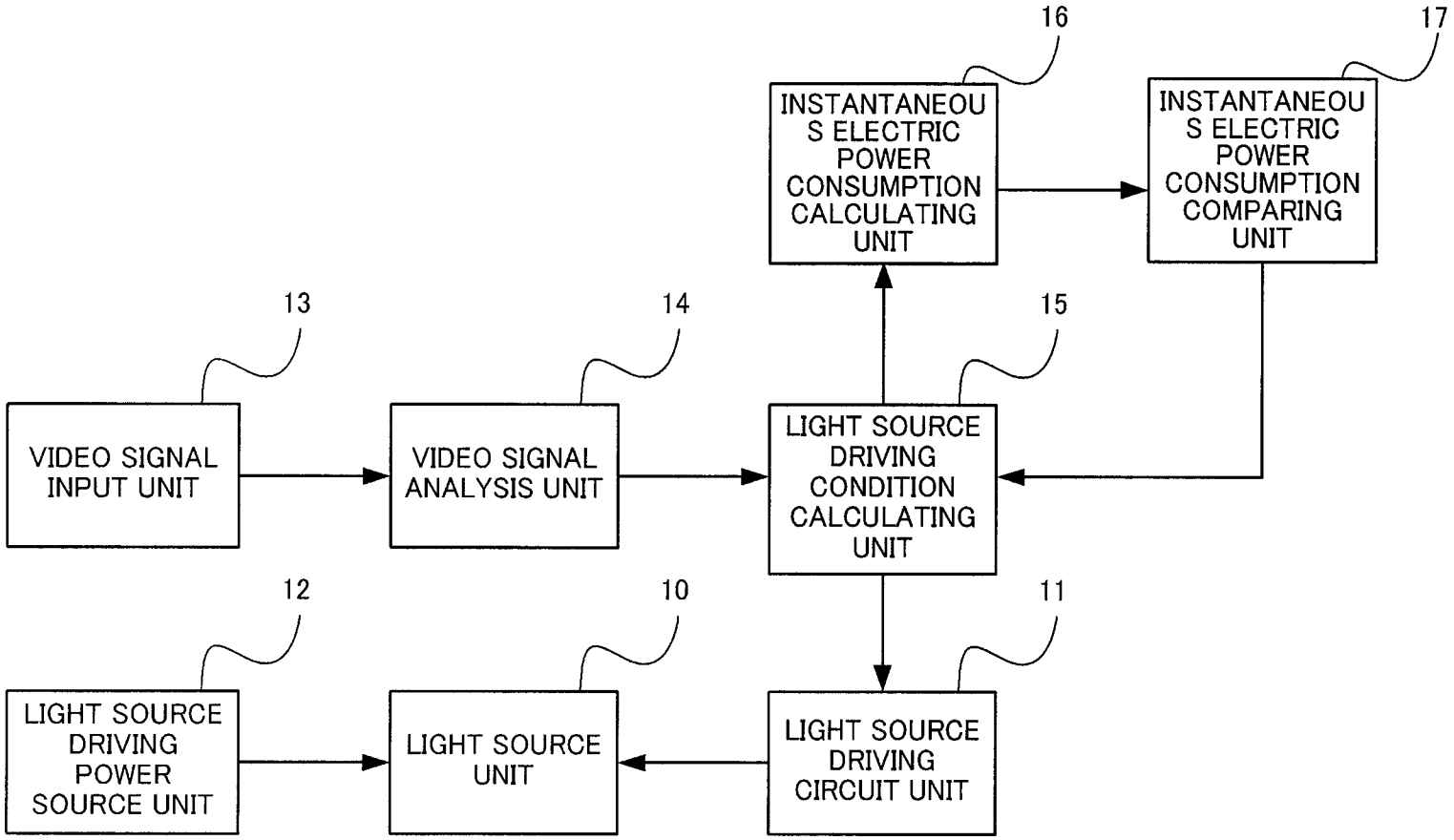
FIG. 1A shows a block diagram illustrating a schematic arrangement of a backlight according to a first embodiment.

FIG. 1 shows a block diagram illustrating a schematic arrangement of a backlight according to an embodiment of the present invention. An explanation will be made below with reference to FIG. 1A about the arrangement of the backlight according to the first embodiment of the present invention. The backlight of this embodiment can be used as a backlight for a liquid crystal display apparatus. Therefore, the present invention also includes any liquid crystal display apparatus comprising the backlight of this embodiment and a liquid crystal display panel which is arranged in front of the backlight and which displays an image by regulating the transmittance of light allowed to come from the backlight in accordance with an image signal.

The backlight shown in FIG. 1A is composed of a light source unit 10, a light source driving circuit unit 11, a light source driving power source unit 12, a video signal input unit 13, a video signal analysis unit 14, a light source driving condition calculating unit 15, an instantaneous electric power consumption calculating unit 16, and an instantaneous electric power consumption comparing unit 17.

Figure 1B:
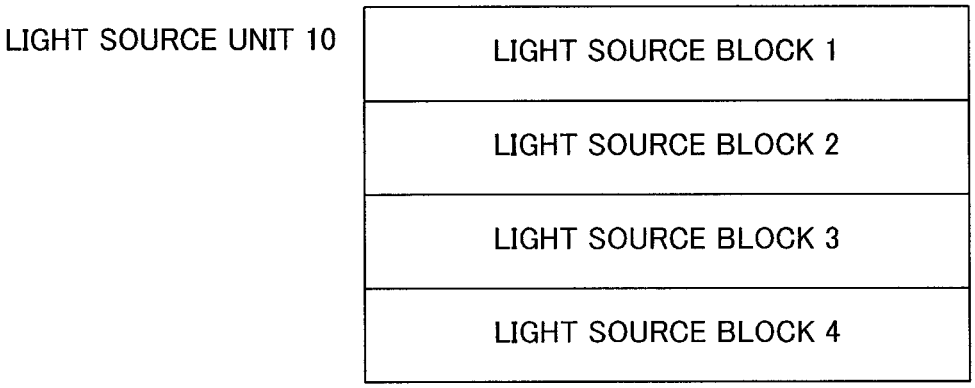

The light source unit 10 is a member which irradiates a liquid crystal panel of a liquid crystal display apparatus from a backward position. The light source unit 10 is composed of a plurality of light sources for each of which the light emission can be independently controlled. The light source can be exemplified, for example, by a fluorescent lamp and a light emitting diode (LED). In this embodiment, it is assumed that the light source unit 10 is provided with N pieces ($N \geq 2$) of light sources. Alternatively, the light source unit 10 may be composed of N pieces ($N \geq 2$) of light source assemblies (sets) for which the light emission can be independently controlled. In this case, it is assumed that one light source assembly is composed of a plurality of light sources, and the light sources, which belong to the same light source assembly, are mutually driven by an identical control signal. The light source assembly is referred to as "light source block". The light source or the light source block, which serves as the unit for controlling the light emission, is constructed so that the light source or the light source block corresponds to each of a plurality of divided areas which are set in an image display area of the liquid crystal display panel. In the case of the backlight of this embodiment, the local dimming control is performed such that the luminance of the light source or the light source block, which corresponds to each of the divided areas, is variably controlled in accordance with the statistical amount (for example, the image level, the gradation value, or the histogram) of the image to be displayed on each of the divided areas. In the following description, the light source or the light source block, which serves as the unit for controlling the light emission, is generally referred to as "light source block" for the purpose of simplification. That is, each of the light source blocks is composed of one light source or a plurality of light sources. As shown in FIG. 1B, this embodiment will be explained assuming that the number of the light source blocks is 4. However, the number of the light source blocks is not limited thereto. Further, various types are conceived for the dividing method for dividing the backlight by the light source blocks when the area is divided into four, i.e., the dividing method for dividing the display area of the liquid crystal panel by the divided areas, and the dividing method is not specifically limited. For example, the following methods are conceived, i.e., a method in which the area is divided in a matrix form to provide vertical 3 blocks×lateral 4 blocks as shown in FIG. 1C and a dividing method in which 4 blocks are provided, for example, in a strip-shaped form in the lateral direction.

The light source driving circuit unit 11 is a driving circuit which drives the light source unit 10. The light source driving circuit unit 11 is composed of a constant current circuit and a PWM (Pulse Width Modulation) driving circuit. The light source driving circuit unit 11 adjusts the luminance of each of the light source blocks of the light source unit 10 in accordance with the magnitude of the current allowed to flow to the light source unit 10 and the pulse-width modulation of the PWM driving. In this embodiment, in order to simplify the explanation, it is assumed that the luminance of the light source block is adjusted by means of the PWM value, and the current is constant for each of the light source blocks irrelevant to the luminance. That is, in this embodiment, the luminance of the light source block is controlled by changing the ratio between the turned-on period and the turned-off period of the light source block in a certain period (in the PWM cycle). In this embodiment, it is possible to set different PWM values for the respective light source blocks. Accordingly, the light source blocks are constructed so that the luminance can be independently controlled for each of the light source blocks. In this context, the PWM value is the pulse width modulation value in the PWM control, and the PWM value is set at 4096 levels in this embodiment. That is, if the PWM value is 0, the luminance of the light source block is minimized (0%), while if the PWM value is 4095, the luminance of the light source block is maximized (100%). Further, it is assumed that the length of 1 cycle (referred to as "PWM cycle") of the PWM control is equal to the length of the period of 1 frame. It is noted that the foregoing conditions are merely described as examples in order to explain this embodiment. The condition of the PWM control is not limited thereto. The present invention is also applicable to any light source control apparatus in which the PWM cycle is different from the frame cycle. The light source block is turned ON in a period of the length corresponding to the PWM value during the PWM cycle, and the light source block is turned OFF in any period other than the above. If the PWM value is 0, the light source block is turned OFF over the entire PWM cycle. If the PWM value is 4095, the light source block is turned ON over the entire PWM cycle. If the PWM value is any value other than the above, then a part of the PWM cycle is the turned-on period, and the remaining portion is the turned-off period. The start timing of the turned-on period is referred to as "turn-on reference timing" in this embodiment. It is assumed that the turn-on reference timing of the nth (n=1, 2, . . . , N) light source block (hereinafter referred to as "light source n" in some cases) is represented by $t_n$. It is assumed that the length of the PWM cycle is represented by $L_{_all}$ (4096 in this embodiment), and the length of the turned-off period of the light source n is represented by $L_{n_off}$. Therefore, the relationship with respect to the length (PWM value) $L_{n_on}$ of the turned-on period of the light source n is represented by $L_{n_on}=L_{_all}-L_{n_off}$. In the case of the backlight of this embodiment, the turn-on reference timings of the plurality of light source blocks are allowed to differ among the respective light source blocks. Accordingly, it is contemplated to deconcentrate the electric power load. However, when the luminance of each of the light source blocks is variably controlled in accordance with the image signal by means of the local dimming control as described above, the instantaneous electric power load may be increased in some cases, if the turn-on reference timing is merely allowed to differ for each of the light source blocks. This embodiment is characterized in that the luminance of each of the light source blocks is corrected so that the instantaneous electric power load is not larger than a predetermined threshold value. Details will be described later on.

The light source driving power source unit 12 is a power source circuit which is provided to supply the forward direction voltage to the light source unit 10. The voltage, which is generated by the power source circuit, may be subjected to the feedback control depending on, for example, the luminance of each of the light source blocks of the light source unit 10 and/or the series connection number of LEDs (when the light source is LED).

The video signal input unit 13 is a receiving circuit for receiving a video signal outputted by an external video signal output apparatus (not shown).

The video signal analysis unit 14 analyzes the video signal received by the video signal input unit 13. The video signal analysis unit 14 calculates the luminance of each of the light source blocks of the light source unit 10 on the basis of the analysis result. The video signal analysis unit 14 calculates the luminance at which the light emission should be performed by each of the light source blocks, for example, on the basis of the statistical amount (for example, the gradation value) of each of the pixels of the divided area corresponding to each of the light source blocks. A method, which is used for the general local dimming control, can be used as the method for determining the luminance of each of the light source blocks on the basis of the analysis result of the video signal. Therefore, any detailed explanation is omitted herein.

The light source driving condition calculating unit 15 calculates the PWM value and the current allowed to flow to each of the light source blocks in accordance with the luminance of each of the light source blocks calculated by the video signal analysis unit 14.

The instantaneous electric power consumption calculating unit 16 calculates the electric power consumption (referred to as "instantaneous electric power consumption") at the turn-on reference timing of each of the light source blocks when each of the light source blocks is driven with the PWM value and the current value calculated by the light source driving condition calculating unit 15.

The instantaneous electric power consumption comparing unit 17 compares the instantaneous electric power consumption at each of the turn-on reference timings calculated by the instantaneous electric power consumption calculating unit 16 with the electric power capable of being instantaneously supplied by the light source driving power source unit 12. The electric power capable of being instantaneously supplied by the light source driving power source unit 12 represents the electric power amount which can be supplied at a certain timing by the light source driving power source unit 12, which is previously determined as the specification of the light source driving power source unit 12. In the case of such a construction that the operation mode of the liquid crystal display apparatus can be switched, for example, into the electric power saving mode in view of the consumption of the electric power, the electric power capable of being instantaneously supplied may be a variable value depending on the operation mode.

An explanation will be made below with reference to FIG. 2 about such a process that the instantaneous electric power consumption, which is provided at the turn-on reference timing of each of the light source blocks, does not exceed the electric power capable of being instantaneously supplied by the light source driving power source unit 12 in the backlight for the liquid crystal display apparatus according to the first embodiment of the present invention. A flow chart shown in FIG. 2 includes a luminance correcting process for each of the light source blocks.

At first, in Step S100, the video signal input unit 13 receives the video signal (picture signal) outputted by the external video signal output apparatus.

Subsequently, in Step S101, the video signal analysis unit 14 calculates the luminance of each of N pieces of the light source blocks for constructing the backlight, from the gradation value of each of the pixels for constructing the video signal received by the video signal input unit 13.

Subsequently, in Step S102, the light source driving condition calculating unit 15 calculates the driving condition (PWM value and the current allowed to flow to each of the light source blocks) of each of N pieces of the light source blocks in accordance with the luminance of each of N pieces of the light source blocks calculated by the video signal analysis unit 14.

Figure 3:
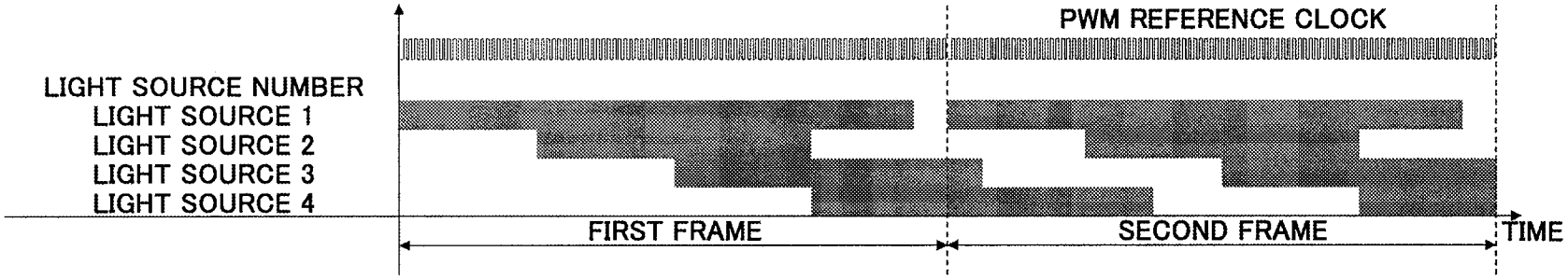
FIG. 3 shows driving conditions of respective light sources in the first embodiment.

In this context, FIG. 3 shows an example of the calculation of the driving condition in Step S102 in the first embodiment. FIG. 3 shows the relationship between the time and the driving conditions of N pieces (N=4 in this embodiment) of the light source blocks (referred to as "light source 1", "light source 2", "light source 3", and "light source 4" in the drawing) for constructing the backlight. It is assumed that the vertical axis in FIG. 3 represents the light source number, and the horizontal axis represents the time. It is assumed that the backlight of this embodiment is constructed by the four light source blocks in total, i.e., the light source block 1 to the light source block 4. It is assumed that the PWM value, which indicates the luminance of the light source block, has a maximum value ($L_{_all}$) of 4096 for 1 frame. In the case of the light source block 1 shown in FIG. 3, for example, the light source block 1 is turned ON for a period of time in which the wave number of the PWM reference clock amounts to 3650 counts from the first frame to the second frame. In the charts of FIG. 3 and the followings for illustrating the driving condition, it is assumed that the gray portion of the graph extending in the horizontal direction indicates the turned-on state, and the white portion indicates the turned-off state.

As shown in FIG. 4A, it is assumed that the respective light source blocks successively start the lighting (turning ON) by using the start points of the turn-on reference timings $t_1$, $t_2$, $t_3$, $t_4$ for which the delay times are provided in an order of the light source blocks 1, 2, 3, 4. In this embodiment, it is assumed that the intervals, which are provided between the turn-on start timings (turn-on reference timings) of the light source blocks that are adjacent to one another in the lighting (turning ON) sequence (order), are equal to one another in relation to all of the light source blocks. That is, it is assumed that the delay time ($\Delta t=t_{n+1}-t_n$) is the length corresponding to 1024 as represented by the PWM value. Further, it is assumed that the light source block 1, which is firstly turned ON in 1 frame period, has the turn-on reference timing which is coincident with the frame start timing. These conditions are described by way of example in order to explain this embodiment. The scope or range of application of the present invention is not limited to the light source control apparatus which fulfills these conditions.

Subsequently, in Step S103, the instantaneous electric power consumption calculating unit 16 calculates the instantaneous electric power consumption value $P_n$ at the turn-on reference timing $t_n$ of the light source block n (n represents the light source number, n=1 to N).

In this context, when such a system is adopted that the plurality of light source blocks for constructing the backlight are successively turned ON as shown in FIG. 4A described above, the maximum value of the instantaneous electric power consumption in 1 frame period is equal to the instantaneous electric power consumption at any one of the turn-on reference timings $t_1$ to $t_4$ of the respective light source blocks. This is because any one of the light source blocks is necessarily turned ON at the turn-on reference timing of each of the light source blocks. This relationship is shown in FIG. 4B. FIG. 4B shows such an example that 1 frame period is divided into sixteen, and the instantaneous electric power consumptions at the respective divided times are subjected to the sampling. It is assumed in FIG. 4B that the amount of contribution to the electric power consumption, which is provided when one light source block is turned ON in each of the divided times, is 25 [W]. When attention is now focused on the first frame, then the maximum value of the instantaneous electric power consumption in 1 frame period is 75 [W], and the instantaneous electric power consumptions, which are provided at the turn-on reference timing $t_3$ of the light source block 3 and the turn-on reference timing $t_4$ of the light source block 4, are equal to the concerning maximum value. In this way, it is appreciated that when the maximum value of the instantaneous electric power consumption is calculated, then it is unnecessary that the instantaneous electric power consumptions should be sampled at all of the divided times in 1 frame period, but it is appropriate that the instantaneous electric power consumptions should be sampled only at the turn-on reference timings of the respective light source blocks.

Further, with reference to FIG. 4B, when attention is paid to the turn-on reference timing $t_1$ in the second frame and the instantaneous electric power consumption at the turn-on reference timing $t_2$, the turned-on periods of the light source block 3 and the light source block 4 allowed to start the lighting in the first frame are continued at the turn-on reference timing $t_1$ in the second frame. Further, the turned-on period of the light source block 4 allowed to start the lighting in the first frame is continued at the turn-on reference timing $t_2$. In this way, when the maximum value of the instantaneous electric power consumption in a certain frame period is calculated, it is necessary to obtain the information of the luminance of the light source block which has the turned-on period continued to at least the next frame and which is included in the respective light source blocks in the frame provided one frame before. Therefore, it is necessary to store the information of the luminance of the light source block included in the previous frame. In view of the above, in order to omit the storage of the information, it is assumed in this embodiment that the change of the driving condition of the light source block is minute between the adjacent frames, and the maximum value of the instantaneous electric power consumption is calculated as follows. That is, as for the light source block which has the turned-on period extended to the next frame beyond the calculation target frame (present frame), it is assumed that the turned-on period, which is the same as the turned-on period provided at and after the start timing of the next frame, exists from the start timing of the present frame. An example is shown in FIG. 4C. In FIG. 4C, the turned-on periods of the light source block 3 and the light source block 4 in the first frame are extended to the second frame. Therefore, the instantaneous electric power consumption calculating unit 16 calculates the maximum value of the instantaneous electric power consumption in the first frame assuming that the turned-on periods included in the second frame also exist at the start timing of the first frame, in relation to the light source block 3 and the light source block 4. If no problem arises in relation to the storage capacity and the processing load, it is also appropriate that the information of the light source driving condition of the previous frame (for example, the PWM value and the luminance) is stored beforehand, and the maximum value of the instantaneous electric power consumption in the present frame is calculated by using the information.

Subsequently, in Step S104, the instantaneous electric power consumption calculating unit 16 calculates the maximum value $P_{max}$ of the instantaneous electric power consumption from N pieces of the instantaneous electric power consumption values $P_n$ (n=1 to N).

Subsequently, in Step S105, the instantaneous electric power consumption comparing unit 17 compares the maximum value $P_{max}$ of the instantaneous electric power consumption calculated by the instantaneous electric power consumption calculating unit 16 with the electric power $P_{limit}$ capable of being instantaneously supplied by the light source driving power source unit 12.

In Step S105, if the maximum instantaneous electric power consumption $P_{max}$ is larger than the electric power $P_{limit}$ capable of being instantaneously supplied by the light source driving power source unit 12 ($P_{max}>P_{limit}$), the process proceeds to Step S106.

In Step S106, the light source driving condition calculating unit 15 calculates the correction coefficient $C_{m_tn}$ in order that the instantaneous electric power consumption, which is provided at the turn-on reference timing $t_n$ to provide the maximum instantaneous electric power consumption $P_{max}$, is not more than the threshold value (not more than the electric power $P_{limit}$ capable of being instantaneously supplied in this case). In this procedure, the correction coefficient $C_{m_tn}$ is the coefficient which is used to correct the light source driving condition determined in Step S102 (referred to as "initial driving condition") in order to determine the light source driving condition under which the light source block m is turned OFF at the turn-on reference timing $t_n$. If the instantaneous electric power consumption is the maximum instantaneous electric power consumption $P_{max}$ at the turn-on reference timing $t_n$, it is necessary that one or more of the light source blocks, which is/are included in the light source blocks turned ON at the turn-on reference timing $t_n$ under the initial driving condition, should be turned OFF at the concerning turn-on reference timing $t_n$. This procedure is required in order that the instantaneous electric power consumption does not exceed the electric power $P_{limit}$ capable of being instantaneously supplied. If a plurality of the light source blocks can be turned OFF at the turn-on reference timing $t_n$, the light source driving condition calculating unit 15 calculates the correction coefficient $C_{m_tn}$ for each of the concerning light source blocks capable of being turned OFF. If a plurality of the turn-on reference timings are provided at each of which the instantaneous electric power consumption is the maximum instantaneous electric power consumption $P_{max}$, the light source driving condition calculating unit 15 calculates the correction coefficient so that the instantaneous electric power consumption does not exceed the electric power capable of being instantaneously supplied, at each of the concerning turn-on reference timings. When the plurality of correction coefficients are calculated as described above, then the light source driving condition calculating unit 15 selects one correction coefficient from the plurality of correction coefficients, and the selected correction coefficient is used to correct the initial driving condition (details will be described later on). The initial driving condition is corrected such that the PWM values of all of the light source blocks provided under the initial driving condition are evenly multiplied by the determined correction coefficient.

In the example shown in FIG. 4C described above, when the instantaneous electric power consumption is calculated at the turn-on reference timings of the respective light source blocks, then the instantaneous electric power consumption is 75 [W] at all of the turn-on reference timings, and hence $P_{max}$=75 [W] is given. In this embodiment, it is assumed that the electric power amount $P_{limit}$ capable of being instantaneously supplied by the light source driving power source unit 12 is 50 [W]. Therefore, in the example shown in FIG. 4C, the light source driving condition calculating unit 15 calculates the correction coefficient in order that the instantaneous electric power consumption is not more than 50 [W] at each of the turn-on reference timings $t_1$, $t_2$, $t_3$, and $t_4$.

An explanation will now be made in detail with reference to FIGS. 5 to 10 about the calculating method for calculating the light source driving condition as performed by the light source driving condition calculating unit 15, the instantaneous electric power consumption calculating unit 16, and the instantaneous electric power consumption comparing unit 17 in S106.

At first, an explanation will be made about a calculating method for calculating the correction coefficient in order that the instantaneous electric power consumption is not more than $P_{limit}$ at the turn-on reference timing $t_1$. In order to calculate the correction coefficient, the degree of decrease is calculated for the luminances of the light source block 1 to the light source block 4 so that the instantaneous electric power consumption can be suppressed to be not more than $P_{limit}$ at the turn-on reference timing $t_1$. The light source block 1 is necessarily turned ON, because $t_1$ is the turn-on reference timing of the light source block 1. Therefore, the instantaneous electric power consumption can be suppressed at $t_1$ by turning OFF the light source block 2, the light source block 3, and the light source block 4 except for the light source block 1 at the turn-on reference timing $t_1$.

Figure 5:
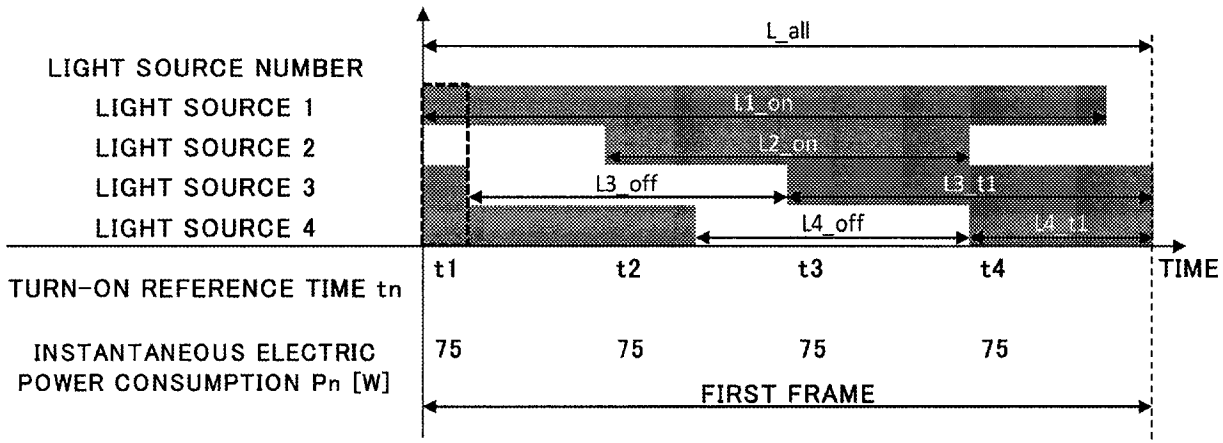
FIG. 5 shows a correction coefficient calculating method at a turn-on reference timing $t_1$ for each of the light sources in the first embodiment.

In the next place, an explanation will be made with reference to FIG. 5 about a calculating method for calculating the correction coefficient $C_{n_t1}$ (n=2, 3, 4) to turn OFF the light source block 2, the light source block 3, and the light source block 4 at the turn-on reference timing $t_1$. The light source driving condition calculating unit 15 calculates the correction coefficient $C_{n_t1}$ as follows in order to turn OFF the light source block n at the turn-on reference timing $t_1$. That is, the ratio is determined between the PWM value $L_{n_on}$ of the light source block n and the PWM value $L_{n_t1}$ (n=2, 3, 4) corresponding to the length of the turned-on period from the turn-on reference timing $t_n$ of the light source block n to the turn-on reference timing $t_1$ as the calculation target of the correction coefficient in the turned-on period of the light source block n. In this procedure, $L_{n_on}$ is synonymous with the difference obtained by subtracting the turned-off period $L_{n_off}$ of the light source block n from the maximum PWM value $L_{_all}$ (4096 in this embodiment) in relation to 1 frame.

At first, the light source block 2 is turned OFF at the turn-on reference timing $t_1$, and hence no influence is exerted on the instantaneous electric power consumption at the turn-on reference timing $t_1$. Therefore, it is unnecessary to calculate the correction coefficient.

In the next place, the light source block 3 is considered. The light source block 3 is turned ON from the turn-on reference timing $t_3$ of the light source block 3 to the turn-on reference timing $t_1$. Therefore, the correction coefficient which is available to turn OFF the light source block 3 at the turn-on reference timing $t_1$, is as follows assuming that the PWM value from $t_3$ to $t_1$ is represented by $L_{3_t1}$.

$$C_{3_t1} = \frac{L_{3_t1}}{L_{_all} - L_{3_off}} = \frac{2048}{2300} = 0.890 \quad (1)$$

Similarly, the correction coefficient $C_{4_t1}$, which is available to turn OFF the light source block 4 at the turn-on reference timing $t_1$, is calculated as follows.

$$C_{4_t1} = \frac{L_{4_t1}}{L_{_all} - L_{4_off}} = \frac{1024}{2600} = 0.394 \quad (2)$$

In order that the instantaneous electric power consumption is not more than $P_{limit}$ at the turn-on reference timing $t_1$, it is necessary to reduce the electric power consumption by 25 [W] according to the following expression.

$$P_{max} - P_{limit} = 75 - 50 = 25 \text{ [W]} \quad (3)$$

Therefore, it is appropriate that any one of the light source block 3 and the light source block 4 is turned OFF. Thus, the correction coefficient $C_{3_t1}$ of the light source block 3 and the correction coefficient $C_{4_t1}$ of the light source block 4 are compared with each other as follows.

$$C_{3_t1} > C_{4_t1} \quad (4)$$

If the PWM values of all of the light source blocks under the initial driving condition are multiplied by $C_{4_t1}$, both of the light source block 3 and the light source block 4 are turned OFF at the turn-on reference timing $t_1$. It is enough that only one light source block is turned OFF at the turn-on reference timing $t_1$. Therefore, it is appropriate that the correction coefficient $C_{3_t1}$ is selected in this case.

The light source driving condition calculating unit 15 also performs the same or equivalent calculation in relation to the turn-on reference timings $t_2$, $t_3$, $t_4$ at each of which the instantaneous electric power consumption is the maximum instantaneous electric power consumption $P_{max}$.

Figure 6:
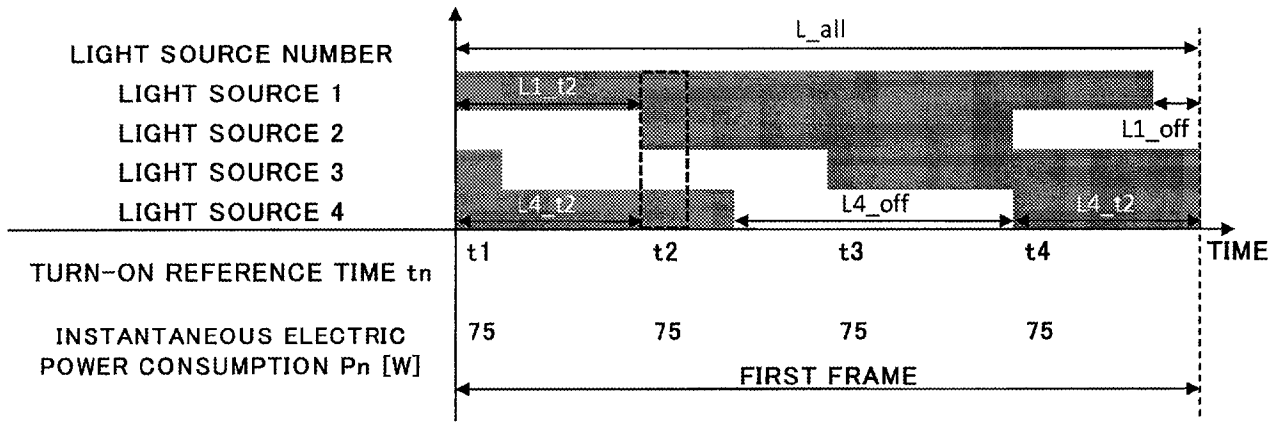
FIG. 6 shows a correction coefficient calculating method at a turn-on reference timing $t_2$ for each of the light sources in the first embodiment.

As shown in FIG. 6, the correction coefficients $C_{n_t2}$ at the turn-on reference timing $t_2$ are as follows.

$$C_{1_t2} = 0.281 \quad (5)$$

$$C_{4_t2} = 0.788 \quad (6)$$

In order that the instantaneous electric power consumption does not exceed the electric power $P_{limit}$ capable of being instantaneously supplied, at the turn-on reference timing $t_2$, it is appropriate that the instantaneous electric power consumption is reduced by 25 [W]. That is, it is appropriate to turn OFF only one of the light source blocks to be turned ON at the turn-on reference timing $t_2$ under the initial driving condition. Therefore, the light source driving condition calculating unit 15 selects $C_{4_t2}$ which is the larger correction coefficient, as the correction coefficient to be used at the turn-on reference timing $t_2$.

Figure 7:
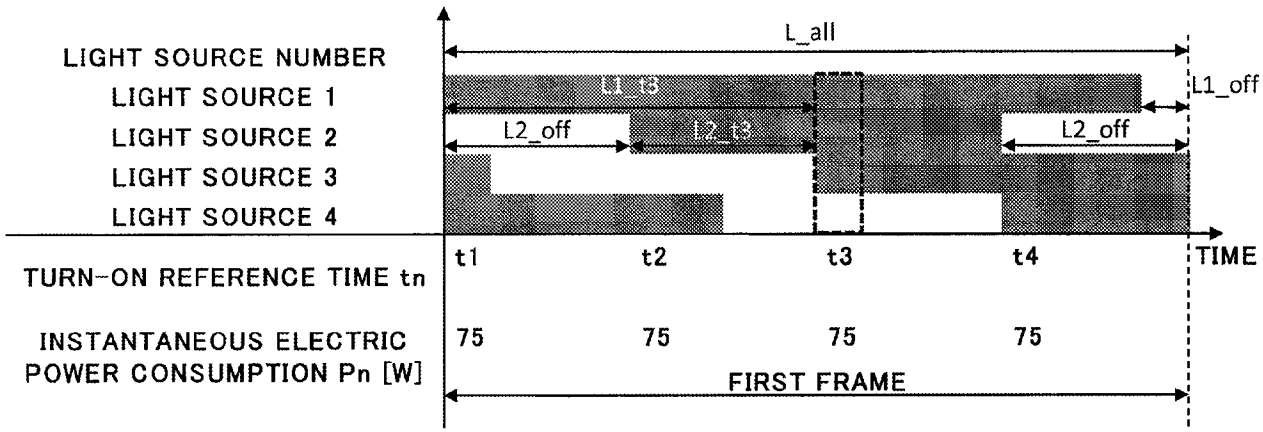
FIG. 7 shows a correction coefficient calculating method at a turn-on reference timing $t_3$ for each of the light sources in the first embodiment.

As shown in FIG. 7, the correction coefficients $C_{n_t3}$ at the turn-on reference timing $t_3$ are as follows.

$$C_{1_t3} = 0.561 \quad (7)$$

$$C_{2_t3} = 0.522 \quad (8)$$

In order that the instantaneous electric power consumption does not exceed the electric power $P_{limit}$ capable of being instantaneously supplied, at the turn-on reference timing $t_3$, it is appropriate that the instantaneous electric power consumption is reduced by 25 [W]. That is, it is appropriate to turn OFF only one of the light source blocks to be turned ON at the turn-on reference timing $t_3$ under the initial driving condition. Therefore, the light source driving condition calculating unit 15 selects $C_{1_t3}$ which is the larger correction coefficient, as the correction coefficient to be used at the turn-on reference timing $t_3$.

Figure 8:
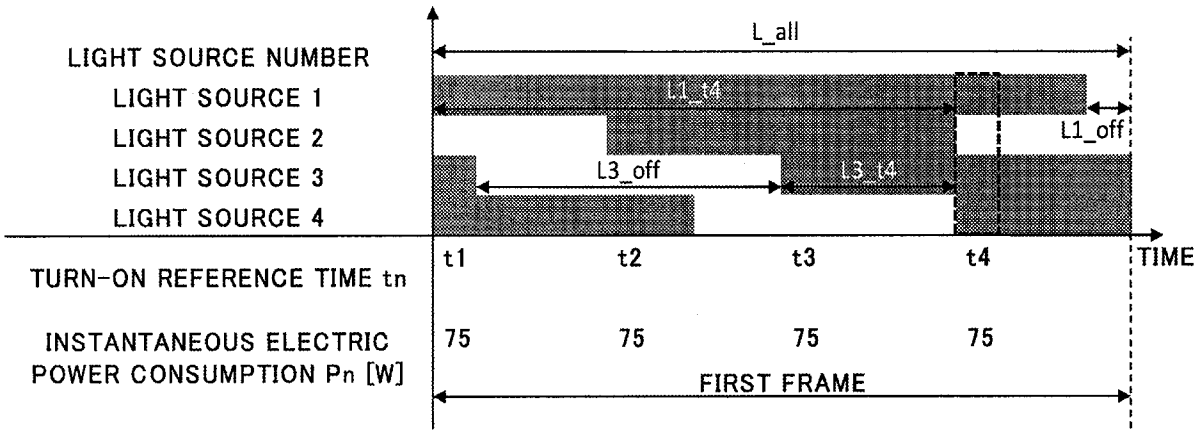
FIG. 8 shows a correction coefficient calculating method at a turn-on reference timing $t_4$ for each of the light sources in the first embodiment.

As shown in FIG. 8, the correction coefficients $C_{n_t4}$ at the turn-on reference timing $t_4$ are as follows.

$$C_{1_t4} = 0.842 \quad (9)$$

$$C_{3_t4} = 0.445 \quad (10)$$

In order that the instantaneous electric power consumption does not exceed the electric power $P_{limit}$ capable of being instantaneously supplied, at the turn-on reference timing $t_4$, it is appropriate that the instantaneous electric power consumption is reduced by 25 [W]. That is, it is appropriate to turn OFF only one of the light source blocks to be turned ON at the turn-on reference timing $t_4$ under the initial driving condition. Therefore, the light source driving condition calculating unit 15 selects $C_{1_t4}$ which is the larger correction coefficient, as the correction coefficient to be used at the turn-on reference timing $t_4$.

Figure 2:
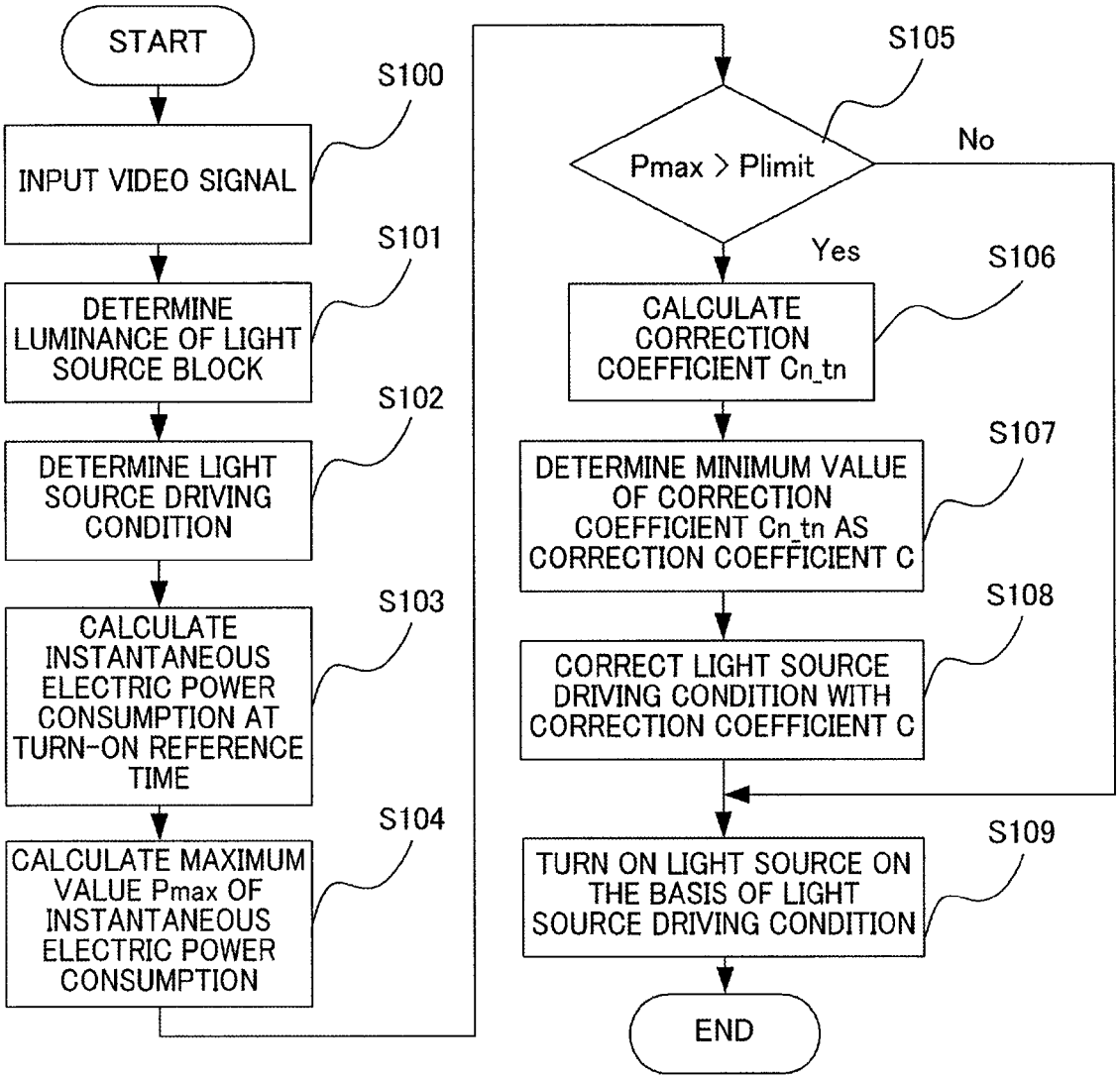
FIG. 2 shows a flow chart to explain a light source luminance correcting process according to the first embodiment.

The calculating process for calculating the correction coefficient $C_{m_tn}$ in Step S106 shown in FIG. 2 has been described above.

Subsequently, in Step S107, the light source driving condition calculating unit 15 selects the minimum value of the correction coefficients. FIG. 9 shows a list of the correction coefficients which are calculated in Step S106 and which are available in order that the instantaneous electric power consumptions, which are provided at the turn-on reference timings $t_1$, $t_2$, $t_3$, and $t_4$, are suppressed to be not more than the electric power $P_{limit}$ capable of being instantaneously supplied. When the minimum value of the correction coefficients $C_{m_tn}$ of the respective turn-on reference timings is used to correct the initial driving condition, the instantaneous electric power consumption can be suppressed to be not more than the electric power $P_{limit}$ capable of being instantaneously supplied, at all of the turn-on reference timings, while maintaining the luminance balance in relation to the plurality of light source blocks (light source blocks 1 to 4). In the example shown in FIG. 9, the light source driving condition calculating unit 15 selects $C_{1_t3}$ as the correction coefficient C used to correct the initial driving condition.

Subsequently, in Step S108, the light source driving condition calculating unit 15 multiplies the PWM values of all of the light source blocks under the initial driving condition by the correction coefficient C calculated in S107 to calculate a new light source driving condition. The light source driving condition after the correction obtained as described above is shown in FIG. 10.

Finally, in Step S109, the light source driving circuit unit 11 drives the light source unit 10 in accordance with the light source driving condition after the correction as calculated by the light source driving condition calculating unit 15, and thus the respective light source blocks are turned ON.

The instantaneous electric power consumption suppressing process of the first embodiment has been described above. According to this embodiment, it is possible to suppress the instantaneous electric power consumption of the backlight from exceeding the electric power capable of being instantaneously supplied by the power source, while maintaining the luminance balance in relation to the plurality of light source blocks (light source blocks 1 to 4) in the backlight for which the local dimming control is performed.

Figure 10:
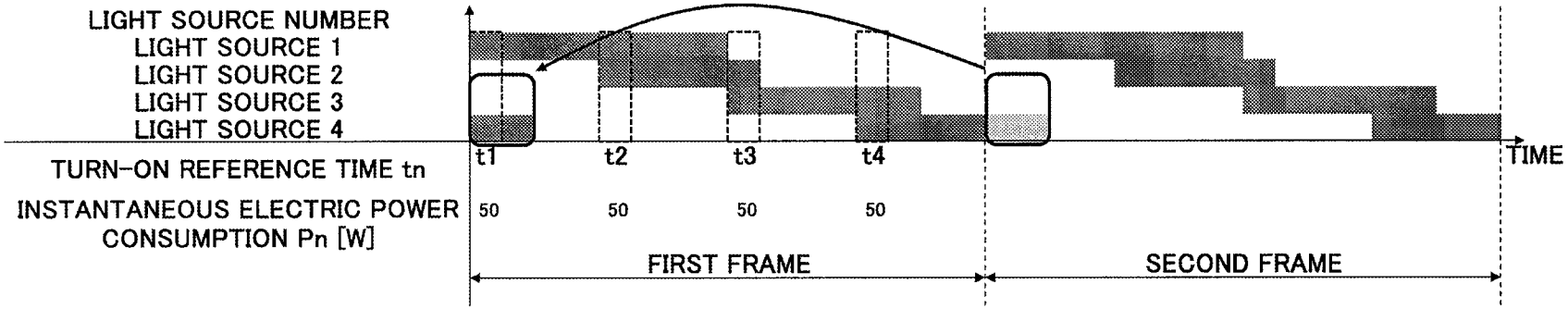
FIG. 10 shows driving conditions and instantaneous electric power consumption values after the correction for the respective light sources in the first embodiment.

When the light source blocks are arranged in a matrix form as shown in FIG. 10, the maximum instantaneous electric power consumption $P_{max}$ is calculated for each of the turn-on start timings of all of the light source blocks 1A to 3D arranged in the matrix form. If $P_{max}$ exceeds $P_{limit}$, then the correction coefficient is calculated for the light source other than the light source block for which the turn-on reference timing to provide $P_{max}$ is the start timing, and the PWM values of all of the light source blocks 1A to 3D are multiplied by the calculated correction coefficient. In general, it is desirable that the turn-on start timings of the respective light source blocks are conformed to the scanning direction of the liquid crystal display apparatus to be combined with this backlight. When the liquid crystal display apparatus to be combined is based on the successive scanning in the vertical direction, the number of calculation operations can be also reduced by allowing the turn-on start timings of the light source blocks aligned in the row direction to coincide with each other.

Second Embodiment

In a second embodiment, an explanation will be made about such an example that the light source block, which has the highest luminance under the initial driving condition, is excluded from the correction target to perform the correction in order that the decrease in the contrast ratio is suppressed in the local dimming control. In the example shown in FIG. 3, the luminance of the light source block 1 is the highest (PWM value is the largest). Therefore, in this embodiment, the correction coefficient is determined while excluding the light source block 1 from the target to be turned OFF, when the correction coefficient is calculated in order that the instantaneous electric power consumption, which is provided at the turn-on reference timing to provide the maximum value $P_{max}$ of the instantaneous electric power consumption, is not more than the electric power $P_{limit}$ capable of being instantaneously supplied.

An explanation will be made below principally about the difference from the first embodiment in relation to the correction coefficient calculating process performed in Step S106 shown in FIG. 2.

At first, in Step S106 shown in FIG. 2, the light source driving condition calculating unit 15 calculates the instantaneous electric power consumption at the turn-on reference timing of each of the light source blocks in the same manner as in the first embodiment. The light source driving condition calculating unit 15 determines the maximum instantaneous electric power consumption and determines the turn-on reference timing at which the instantaneous electric power consumption has the maximum value $P_{max}$. As explained in the first embodiment, all of $t_1$, $t_2$, $t_3$, and $t_4$ are the turn-on reference timings which fulfill the condition in the example shown in FIG. 4C.

An explanation will be made with reference to FIG. 11 about a calculating method for calculating the correction coefficient in order that the instantaneous electric power consumption is not more than $P_{limit}$ at the turn-on reference timing $t_1$ in the second embodiment. The light source block 1 is necessarily turned ON at the turn-on reference timing $t_1$. Therefore, it is possible to suppress the instantaneous electric power consumption by turning OFF the light source block 2, the light source block 3, and the light source block 4 except for the light source block 1 at the turn-on reference timing $t_1$. The light source block 2 is turned OFF at the turn-on reference timing $t_1$ under the initial driving condition. Therefore, the correction coefficients are calculated for only the light source block 3 and the light source block 4.

Figure 11:
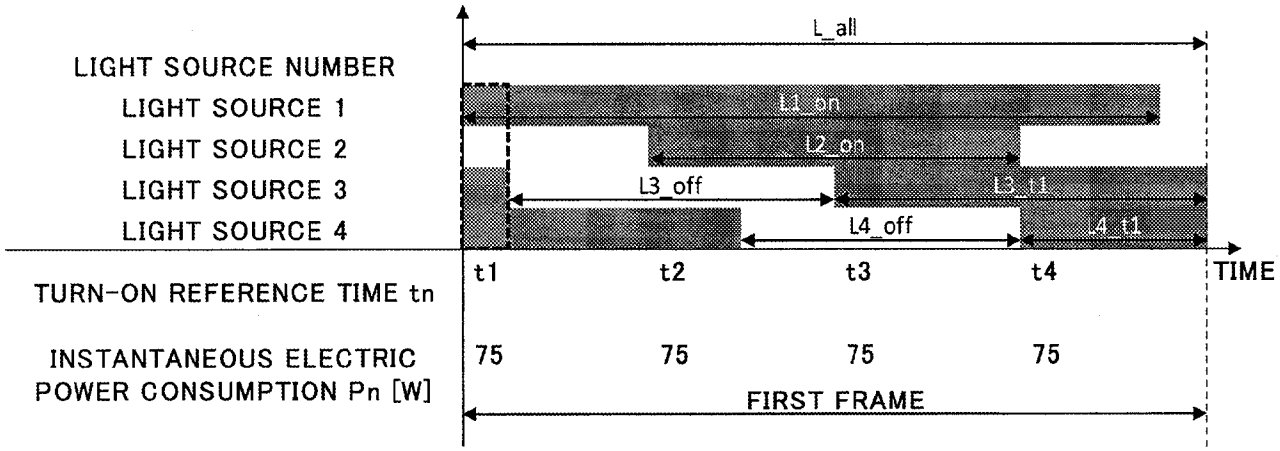
FIG. 11 shows a correction coefficient calculating method at a turn-on reference timing $t_1$ for each of light sources in a second embodiment.

The correction coefficients $C_{n_t1}$ (n=3, 4), which are available to turn OFF the light source block 3 and the light source block 4 at $t_1$, are calculated as follows as shown in FIG. 11 in the $$C_{3_t1} = \frac{L_{3_t1}}{L_{_all} - L_{3_off}} = \frac{2048}{2300} = 0.890 \tag{11}$$

same manner as in the first embodiment.

$$C_{3_t1} = \frac{L_{3_t1}}{L_{_all} - L_{3_off}} = \frac{2048}{2300} = 0.890 \tag{11}$$

$$C_{4_t1} = \frac{L_{4_t1}}{L_{_all} - L_{4_off}} = \frac{1024}{2600} = 0.394 \tag{12}$$

In order that the instantaneous electric power consumption is not more than $P_{limit}$ at the turn-on reference timing $t_1$, it is necessary to reduce the electric power consumption by 25 [W] according to the following expression.

$$P_{max} - P_{limit} = 75 - 50 = 25 \text{ [W]} \tag{13}$$

Therefore, it is appropriate that any one of the light source block 3 and the light source block 4 is turned OFF. Thus, the correction coefficient $C_{3_t1}$ of the light source block 3 and the correction coefficient $C_{4_t1}$ of the light source block 4 are compared with each other as follows.

$$C_{3_t1} > C_{4_t1} \tag{14}$$

If the PWM values of all of the light source blocks under the initial driving condition are multiplied by $C_{4_t1}$, both of the light source block 3 and the light source block 4 are turned OFF at the turn-on reference timing $t_1$. It is enough that only one light source block is turned OFF at the turn-on reference timing $t_1$. Therefore, it is appropriate that the correction coefficient $C_{3_t1}$ is selected in this case. As for the turn-on reference timing $t_1$, the result, which is the same as or equivalent to that obtained in the first embodiment, is obtained for the correction coefficient.

Figure 12:
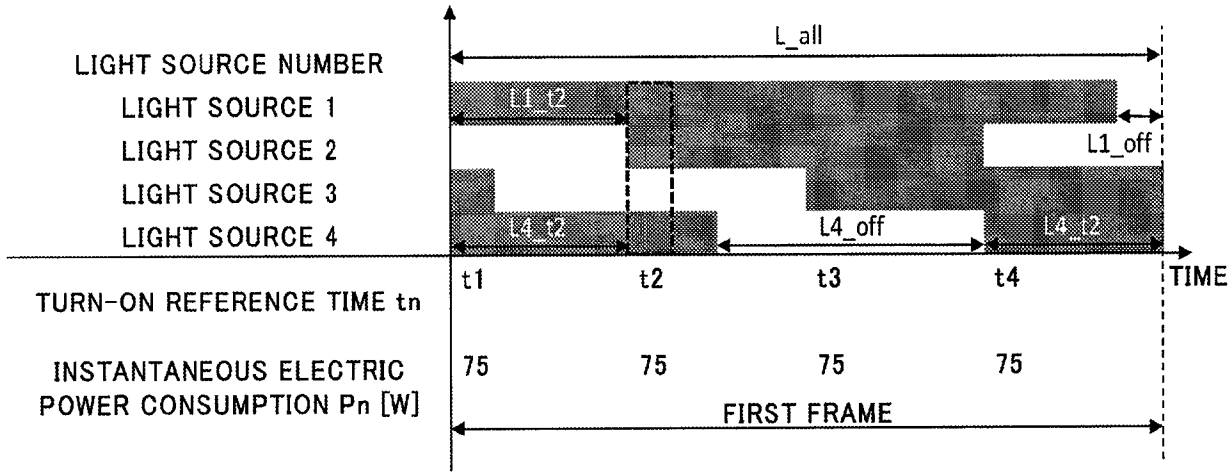
FIG. 12 shows a correction coefficient calculating method at a turn-on reference timing $t_2$ for each of the light sources in the second embodiment.

In the next place, an explanation will be made about the calculation of the correction coefficient at the turn-on reference timing $t_2$. The light source block 1, the light source block 2, and the light source block 4 are turned ON at the turn-on reference timing $t_2$ under the initial driving condition. However, $t_2$ is the turn-on reference timing of the light source block 2, and hence the light source block 2 cannot be the target to be turned OFF. Further, the light source block 1 is the light source having the highest luminance in the first frame, and hence the luminance is not corrected therefor in the second embodiment (light source block 1 is not the target to be turned OFF at $t_2$). Therefore, the instantaneous electric power consumption is suppressed by performing the luminance correction to turn OFF the light source block 4 at the turn-on reference timing $t_2$. The correction coefficient $C_{4_t2}$, which is available to suppress the instantaneous electric power consumption of the light source block 4 at the turn-on reference timing $t_2$, is as follows as shown in FIG. 12.

$$C_{4_t2} = 0.788 \tag{15}$$

Figure 13:
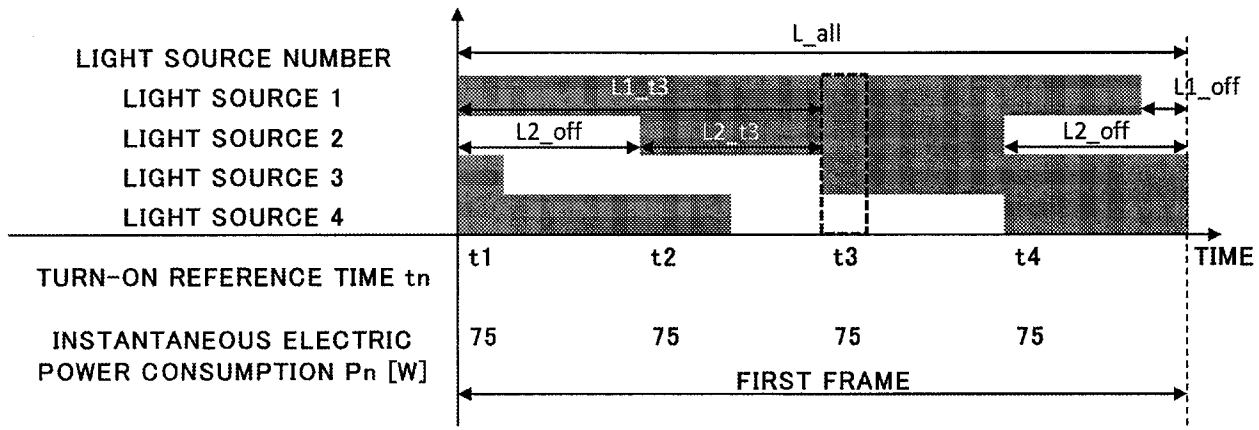
FIG. 13 shows a correction coefficient calculating method at a turn-on reference timing $t_3$ for each of the light sources in the second embodiment.

Similarly, the calculation is also performed in relation to the turn-on reference timings $t_3$, $t_4$. At the turn-on reference timing $t_3$, the light source block 1 and the light source block 2 are turned ON under the initial driving condition. However, the light source block 1 having the maximum luminance is not the target subjected to the correction (to be turned OFF) in the first frame. Therefore, the light source block 2 is the target subjected to the correction (to be turned OFF). Therefore, the correction coefficient $C_{2_t3}$, which is available at the turn-on reference timing $t_3$, is as follows as shown in FIG. 13.

$$C_{2_t3}=0.522 \tag{16}$$

Figure 14:
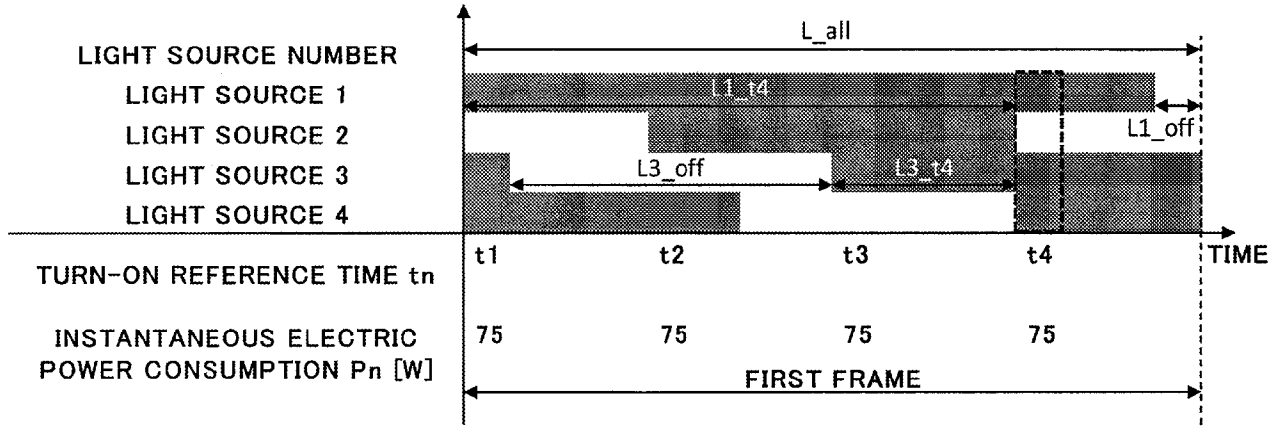
FIG. 14 shows a correction coefficient calculating method at a turn-on reference timing $t_4$ for each of the light sources in the second embodiment.

In the next place, at the turn-on reference timing $t_4$, the light source block 1 and the light source block 3 are turned ON under the initial driving condition. However, the light source block 1 having the maximum luminance is not the target subjected to the correction (to be turned OFF) in the first frame. Therefore, the light source block 3 is the target subjected to the correction (to be turned OFF). Therefore, the correction coefficient $C_{3_t4}$, which is available at the turn-on reference timing $t_4$, is as follows as shown in FIG. 14.

$$C_{3_t4}=0.445 \tag{17}$$

FIG. 15 shows a list of the correction coefficients which are calculated as described above and which are available in order that the instantaneous electric power consumptions, which are provided at the turn-on reference timings $t_1$, $t_2$, $t_3$, and $t_4$, are suppressed to be not more than the electric power $P_{limit}$ capable of being instantaneously supplied. When the minimum value of the correction coefficients $C_{m_tn}$ of the respective turn-on reference timings is used to correct the initial driving condition, the instantaneous electric power consumption can be suppressed to be not more than the electric power $P_{limit}$ capable of being instantaneously supplied, at all of the turn-on reference timings, while maintaining the luminance balance in relation to the light source blocks 2 to 4. In the example shown in FIG. 15, the light source driving condition calculating unit 15 selects $C_{3_t4}$ in Step S107 as the correction coefficient C used to correct the initial driving condition.

Figure 16:
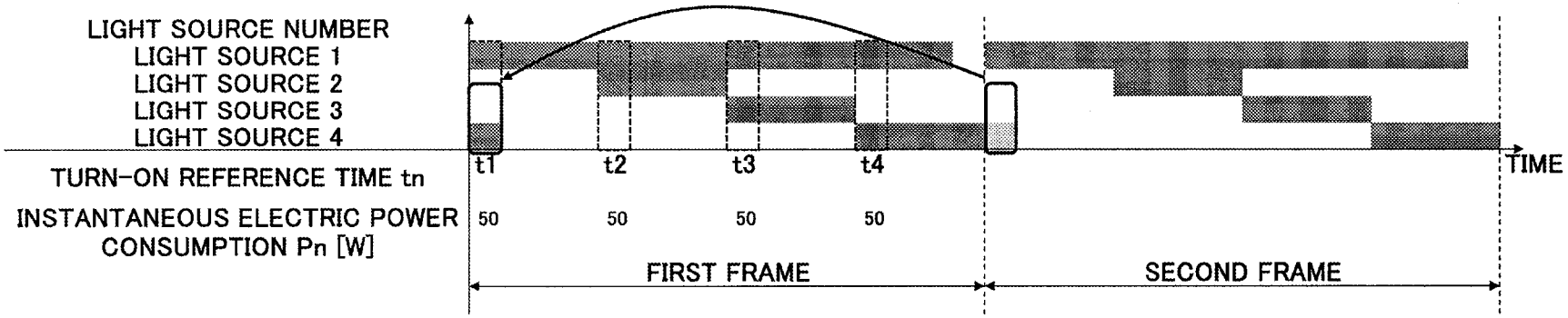
FIG. 16 shows driving conditions and instantaneous electric power consumption values after the correction for the respective light sources in the second embodiment.

In Step S108, the light source driving condition calculating unit 15 multiplies the PWM values of the light source blocks (light source blocks 2, 3, 4) under the initial driving condition except for the light source block 1 for which the luminance is maintained, by the correction coefficient C calculated in S107, and thus a new light source driving condition is calculated. The light source driving condition after the correction obtained as described above is shown in FIG. 16.

According to this embodiment, it is possible to suppress the instantaneous electric power consumption of the backlight from exceeding the electric power capable of being instantaneously supplied by the power source, while maintaining the luminance of the brightest light source block under the initial driving condition in the backlight for which the local dimming control is performed. In this embodiment, the effect is further obtained such that the effect to improve the contrast by means of the local dimming can be suppressed from being lowered, in addition to the effect obtained in the first embodiment.

Third Embodiment

A third embodiment is such an embodiment that the present invention is applied to a backlight wherein a light source unit 10 is composed of light sources of a plurality of colors of, for example, red, green, and blue, and the backlight is turned ON (lighted) at a predetermined chromaticity by turning ON the respective light sources at a predetermined luminance ratio. An explanation will now be made assuming that each of the light source blocks as described in the foregoing embodiment is constructed to include one combination or a plurality of combinations of the light sources of the plurality of colors.

In the case of the third embodiment, the light source driving condition calculating unit 15 calculates the instantaneous electric power consumption at each of the turn-on reference timings for each of the colors of the light sources, and the light source driving condition calculating unit 15 determines the minimum value of the correction coefficient for each of the colors. Further, the light source driving condition calculating unit 15 determines the minimum value of the correction coefficients determined for each of the colors as the correction coefficient to be used for the correction of the initial driving condition, and the PWM values of all of the colors under the initial driving condition are evenly multiplied thereby. Accordingly, the instantaneous electric power consumption can be suppressed to be not more than the electric power $P_{limit}$ capable of being instantaneously supplied, while maintaining the luminance ratio of the light sources of the plurality of colors, i.e., suppressing the fluctuation of the chromaticity of the backlight.

An explanation will be made below principally about the difference from the first embodiment in relation to the correction coefficient calculating process performed in Step S106 shown in FIG. 2.

At first, in Step S106 shown in FIG. 2, the light source driving condition calculating unit 15 calculates the instantaneous electric power consumption at the turn-on reference timing, calculates the maximum instantaneous electric power consumption, and calculates the turn-on reference timing at which the instantaneous electric power consumption has the maximum value, for each of the colors of the light sources for constructing the light source blocks in the same manner as in the first embodiment. FIG. 17A shows the instantaneous electric power consumption in relation to the red light sources, 17B shows the instantaneous electric power consumption in relation to the green light sources, and 17C shows the instantaneous electric power consumption in relation to the blue light sources. As shown in FIG. 17A, the turn-on reference timing, at which the instantaneous electric power consumption has the maximum value, is $t_3$ in the case of the red light sources. As shown in FIG. 17B, the turn-on reference timings, at each of which the instantaneous electric power consumption has the maximum value, are all of $t_1$, $t_2$, $t_3$, and $t_4$ in the case of the green light sources. As shown in FIG. 17C, the turn-on reference timing, at which the instantaneous electric power consumption has the maximum value, is $t_3$ in the case of the blue light sources. The light source driving condition calculating unit 15 determines the correction coefficient in order that the instantaneous electric power consumption is not more than $P_{limit}$ at the turn-on reference timing $t_3$ for each of the red light sources and the blue light sources. Further, the light source driving condition calculating unit 15 determines the correction coefficient in order that the instantaneous electric power consumption is not more than $P_{limit}$ at each of the turn-on reference timings $t_1$, $t_2$, $t_3$, and $t_4$ for each of the green light sources. The way of determining the correction coefficient at the turn-on reference timing $t_n$ is the same as that described in the first embodiment. That is, the light source driving condition calculating unit 15 calculates the correction coefficient for each of the light source blocks (light source blocks as correction candidates) except for the light source block n of the light source blocks which are turned ON at the turn-on reference timing $t_n$ under the initial driving condition. The correction coefficient is the coefficient by which the PWM value of the light source block as the concerning correction candidate is to be multiplied in order that the light source block as the correction candidate is turned OFF at the turn-on reference timing $t_n$. Further, the light source driving condition calculating unit 15 determines the number of the light source block or light source blocks to be turned OFF at the turn-on reference timing $t_n$ in order that the instantaneous electric power consumption, which is provided at the turn-on reference timing $t_n$, is not more than the electric power $P_{limit}$ capable of being instantaneously supplied by the power source. Assuming that the number of the light source block or light source blocks to be turned OFF is represented by X, the light source driving condition calculating unit 15 selects, from the calculated correction coefficients, the Xth correction coefficient as counted from the largest one, as the correction coefficient for the turn-on reference timing $t_n$.

In this embodiment, it is assumed that $P_{limit}$ is 50 [W] for each of the colors. According to FIGS. 17A, 17B, and 17C, the turn-on reference timings, at which the instantaneous electric power consumption has the maximum value, are $t_3$ for the red light source, $t_1$, $t_2$, $t_3$, and $t_4$ for the green light source, and $t_3$ for the blue light source. In any case, the maximum instantaneous electric power consumption is 75 [W]. Therefore, the number X of the light source block to be turned OFF is 1 in relation to all of the turn-on reference timings. According to FIGS. 17A, 17B, and 17C, the number of the light source blocks as the correction candidates is 2 in any case in relation to each of the turn-on reference timings at which the instantaneous electric power consumption has the maximum value. Therefore, the light source driving condition calculating unit 15 calculates two correction coefficients respectively as shown in FIG. 18 in relation to each of the turn-on reference timings of $t_3$ for the red light source, $t_1$, $t_2$, $t_3$, and $t_4$ for the green light source, and $t_3$ for the blue light source. The larger correction coefficient of the calculated correction coefficients is used as the correction coefficient for the concerning turn-on reference timing.

If there are a plurality of the turn-on reference timings for each of which the correction coefficient is to be calculated, i.e., if there are a plurality of the turn-on reference timings at each of which the instantaneous electric power consumption is the maximum instantaneous electric power consumption $P_{max}$, then the light source driving condition calculating unit 15 determines, as the correction coefficient, the minimum value of the correction coefficients in relation to each of the turn-on reference timings. In this embodiment, the correction coefficient is determined for each of the colors. As shown in FIG. 18, the number of the turn-on reference timing for which the correction coefficient is to be calculated is 1 in relation to the red light source and the blue light source. However, the number of the turn-on reference timings for each of which the correction coefficient is to be calculated is 4 in relation to the green light source. Therefore, the light source driving condition calculating unit 15 calculates the correction coefficients for the four turn-on reference timings respectively in relation to the green light source, and the minimum value thereof is determined as the correction coefficient for the green light source.

As shown in FIG. 18, the correction coefficient, which is available to correct the instantaneous electric power consumption of the red light source, is as follows.

$$C_{1_t3_R}=0.679 \tag{18}$$

The correction coefficient, which is available to correct the instantaneous electric power consumption of the green light source, is as follows.

$$C_{1_t3_G}=0.561 \tag{19}$$

The correction coefficient, which is available to correct the instantaneous electric power consumption of the blue light source, is as follows.

$$C_{2_t3_B}=0.994 \tag{20}$$

In this embodiment, the light source driving condition calculating unit 15 determines the minimum value of the correction coefficients calculated for the light sources of the respective colors as described above, as the correction coefficient to be used to correct the initial driving condition. In the example shown in FIG. 18, the minimum correction coefficient, which is included in the correction coefficients calculated for the light sources of the respective colors, is the correction coefficient for the green light source.

$$C_{1_t3_G}=0.561 \tag{21}$$

Therefore, the light source driving condition calculating unit 15 selects $C_{1_t3_G}$ as the correction coefficient C to be used to correct the initial driving condition, and the PWM values of all of the colors of all of the light source blocks under the initial driving condition are multiplied thereby to calculate new light source driving conditions. The light source driving conditions for the respective colors after the correction obtained as described above are shown in FIGS. 19A, 19B, and 19C. According to FIGS. 19A, 19B, and 19C, it is appreciated that the instantaneous electric power consumption is not more than $P_{limit}$ at the turn-on reference timings for all of the colors.

According to this embodiment, it is appreciated that even when the backlight light source is composed of the light sources of the plurality of colors of, for example, red/green/blue, it is possible to suppress the instantaneous electric power consumption in the state in which the desired chromaticity is maintained.

Fourth Embodiment

Figure 21A:
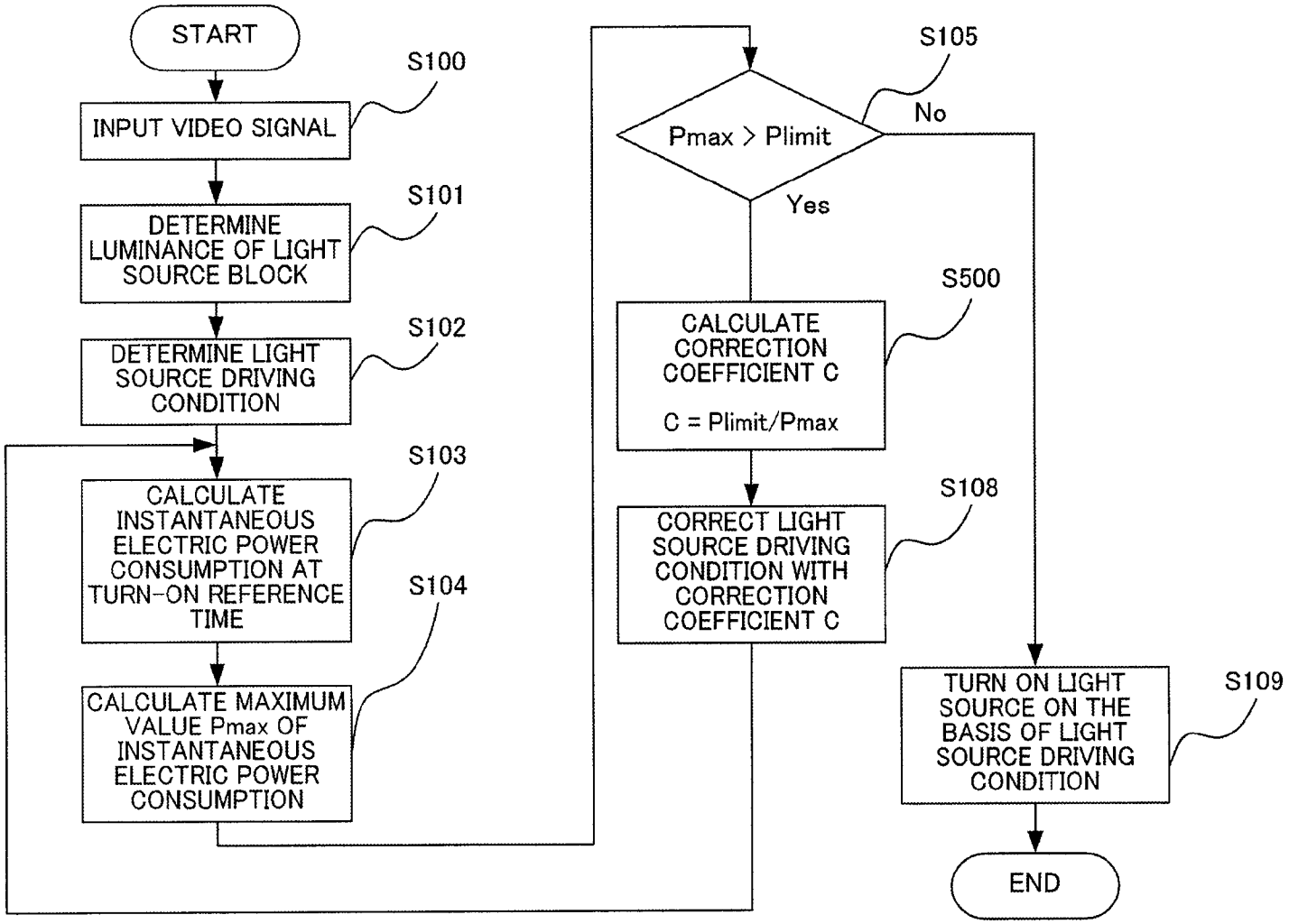
FIG. 21A shows a flow chart to explain a light source luminance correcting process according to the fourth embodiment.

A fourth embodiment is an embodiment which is contemplated to suppress the calculation load for calculating the correction coefficient by the light source driving condition calculating unit 15 shown in FIG. 1A. In the case of a large-sized liquid crystal display apparatus, the number of light source blocks for constructing a backlight is increased. The number of turn-on reference timings is also increased in accordance with the increase in the number of light source blocks for constructing the backlight. Therefore, it is considered that the load on the correction coefficient calculating process may be increased. In view of the above, in the fourth embodiment, an explanation will be made about such an embodiment that the calculating method for calculating the correction coefficient is simplified. In the foregoing embodiments, the following process has been performed in order that the instantaneous electric power consumption, which is provided at the concerning turn-on reference timing $t_n$, is not more than the electric power $P_{limit}$ capable being instantaneously supplied by the light source driving power source unit 12, in relation to the turn-on reference timing $t_n$ at which the instantaneous electric power consumption has the maximum value $P_{max}$. That is, the number of the light source block or light source blocks to be turned OFF at the concerning turn-on reference timing $t_n$ is determined, and the correction coefficient, with which the light source block as the correction candidate is turned OFF at the concerning turn-on reference timing $t_n$, is individually calculated for each of the light source blocks as the correction candidates. The optimum correction coefficient is selected from the calculated correction coefficients depending on the number of the light source block or light source blocks to be turned OFF, and the correction coefficient, which is used to correct the initial driving condition, is determined. In the fourth embodiment, this calculation is simplified. The light source driving condition calculating unit 15 calculates the ratio between the electric power amount $P_{limit}$ capable of being instantaneously supplied and the maximum value $P_{max}$ of the instantaneous electric power consumption, and an obtained result is used as the correction coefficient. An explanation will be made below with reference to a flow chart shown in FIG. 21A. The flow chart shown in FIG. 21A illustrates a correcting process for correcting the light source driving condition in this embodiment. The steps, in which the same processes as those illustrated in the flow chart shown in FIG. 2 are performed, are designated by the same reference numerals as those of the flow chart shown in FIG. 2, any detailed explanation of which will be omitted. If it is judged in Step S105 that the maximum value $P_{max}$ of the instantaneous electric power consumption exceeds $P_{limit}$, then the routine proceeds to Step S500, and the light source driving condition calculating unit 15 calculates the correction coefficient in accordance with the following expression (22).

$$C = \frac{P_{limit}}{P_{max}} \tag{22}$$

Subsequently, in Step S108, the light source driving condition calculating unit 15 corrects the initial driving condition by using the correction coefficient C determined in Step S500 (PWM values of the respective light source blocks are multiplied by the correction coefficient). After that, the process returns to Step S103, and the instantaneous electric power consumption calculating unit 16 calculates the maximum value $P_{max}$ of the instantaneous electric power consumption at each of the turn-on reference timings again on the basis of the light source driving condition after the correction performed in Step S108. The instantaneous electric power consumption comparing unit 17 performs the comparison in Step S105 on the basis of the calculation result. If it is judged that the maximum value $P_{max}$ exceeds the electric power amount $P_{limit}$ capable of being instantaneously supplied, the light source driving condition calculating unit 15 calculates the correction coefficient again by using the expression (22) in Step S500. In Step S108, the light source driving condition after the correction described above is further corrected by using the determined correction coefficient C. The process returns to Step S103 again. The instantaneous electric power consumption calculating unit 16 calculates the instantaneous electric power consumption again on the basis of the light source driving condition after the concerning correction, and the judgment in Step S105 is performed. In the fourth embodiment, the series of the processes are repeated until it is judged in Step S105 that the maximum value $P_{max}$ of the instantaneous electric power consumption is not more than the electric power amount $P_{limit}$ capable of being instantaneously supplied. If it is judged in Step S105 that the maximum value $P_{max}$ of the instantaneous electric power consumption is not more than the electric power amount $P_{limit}$ capable of being instantaneously supplied, then the process proceeds to Step S109, and the light source is driven on the basis of the newest light source driving condition after the correction.

An explanation will be made on the basis of an example shown in FIG. 20A. FIG. 20A shows the initial driving conditions for the light source blocks 1, 2, 3, 4 determined by the light source driving condition calculating unit 15 on the basis of the analysis result of an inputted video signal. It is assumed that the electric power amount $P_{limit}$ capable of being instantaneously supplied is 50 [W] in the same manner as in the first embodiment. If the luminances of the light source block 1 to the light source block 4 are in the condition shown in FIG. 20A, the correction coefficient C is provided as follow, because of the maximum value $P_{max}$ of the instantaneous electric power consumption=75 [W].

$$C = \frac{P_{limit}}{P_{max}} = \frac{50}{75} = 0.667 \tag{23}$$

FIG. 20B shows the light source driving condition after the correction performed for the first time as obtained by multiplying the PWM value of each of the light source blocks under the initial driving condition shown in FIG. 20A by the correction coefficient and the instantaneous electric power consumption at each of the turn-on reference timings calculated on the basis of the light source driving condition after the correction performed for the first time. As shown in FIG. 20B, the maximum value $P_{max}$ of the instantaneous electric power consumption exceeds the electric power amount $P_{limit}$ capable of being instantaneously supplied, even under the light source driving condition after the correction performed for the first time. Therefore, the light source driving condition calculating unit 15 calculates the correction coefficient again in accordance with the expression (22), and the determined correction coefficient C is used to correct the light source driving condition after the correction performed for the first time shown in FIG. 20B. FIG. 20C shows the light source driving condition after the correction performed for the second time as obtained in this way and the instantaneous electric power consumption at each of the turn-on reference timings calculated on the basis of the light source driving condition after the correction performed for the second time. As shown in FIG. 20C, the maximum value $P_{max}$ of the instantaneous electric power consumption, which is provided at each of the turn-on reference timings, is not more than the electric power amount $P_{limit}$ capable of being instantaneously supplied, in any case. Therefore, the light source driving condition calculating unit 15 completes the repeated calculation.

According to this embodiment, it is possible to mitigate the load exerted on the calculating process for calculating the correction coefficient. Therefore, the instantaneous electric power consumption can be preferably suppressed even in the case of the backlight in which the number of the light sources is large and/or the number of the light source blocks is large.

In this embodiment, when the electric power amount $P_{limit}$ capable of being instantaneously supplied, which is used to calculate the correction coefficient, has a smaller value that has an allowance with respect to the specification of the light source driving power source unit 12, then the number of repeated calculations can be reduced, and the calculation load can be further mitigated.

Figure 21B:
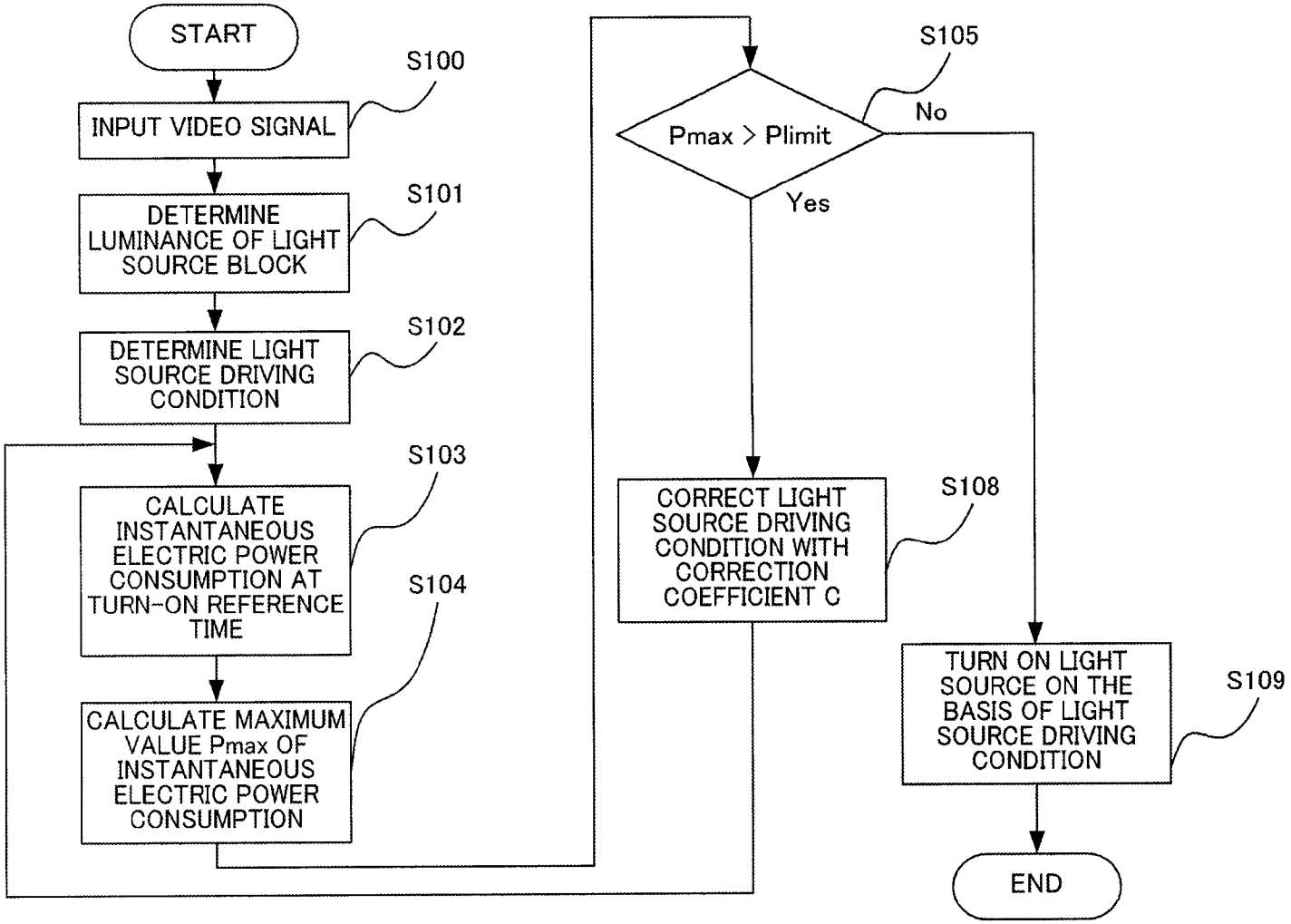
FIG. 21B shows a flow chart to explain another example of the light source luminance correcting process according to the fourth embodiment.

The process in Step S500 shown in FIG. 21A may be omitted, and the correction coefficient C may be a previously determined fixed value (for example, any arbitrary value such as 0.80, 0.60, or 0.50). In this procedure, a process illustrated in a flow chart shown in FIG. 21B is performed. In this procedure, it is unnecessary to calculate the correction coefficient C, and hence it is possible to further reduce the calculation load. An arbitrary value is set before the shipping of the product for the correction coefficient C which is the previously determined fixed value. It is also appropriate that a plurality of correction coefficients C are prepared beforehand before the shipping of the product so that a user can select an arbitrary value of the plurality of correction coefficients after the shipping of the product.

Fifth Embodiment

In the first embodiment to the fourth embodiment, if the suppressing process for suppressing the instantaneous electric power consumption is withdrawn in the frame immediately after performing the suppressing process for suppressing the instantaneous electric power consumption, such a phenomenon arises that the high luminance and the low luminance are repeated. In a fifth embodiment, in order to avoid the phenomenon in which the high luminance and the low luminance are repeated as described above, the hysteresis control is performed such that the instantaneous electric power consumption suppressing process is continued until the maximum value $P_{max}$ of the instantaneous electric power consumption is not more than the correction withdrawal electric power as a predetermined threshold value, after executing the instantaneous electric power consumption suppressing process. The correction withdrawal electric power has a predetermined value which is smaller than the electric power amount $P_{limit}$ capable of being instantaneously supplied by the light source driving power source unit 12.

Figure 22:
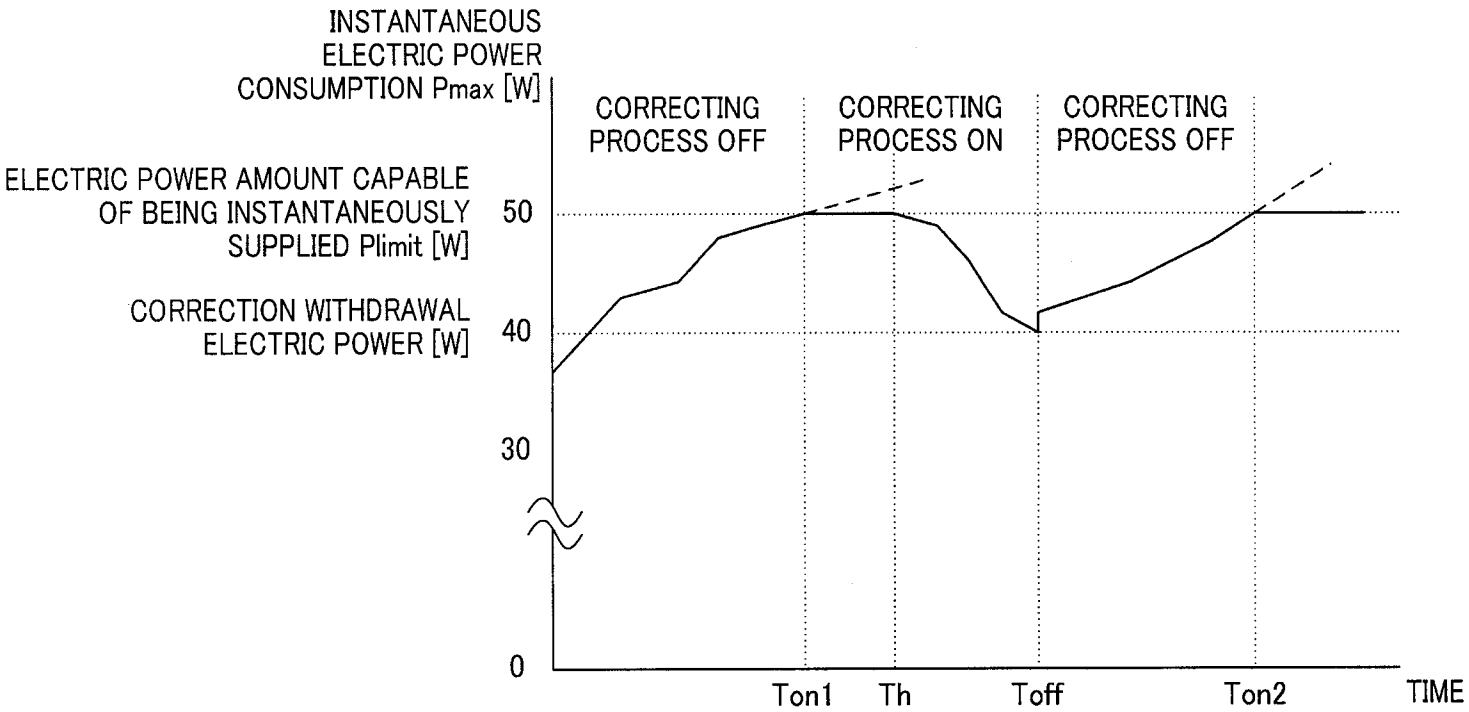
FIG. 22 shows a hysteresis process for a backlight according to a fifth embodiment.

FIG. 22 shows an example of the temporal transition of the maximum instantaneous electric power consumption $P_{max}$ when the hysteresis control according to this embodiment is performed. The horizontal axis represents the time, and the vertical axis represents the maximum instantaneous electric power consumption $P_{max}$.

FIG. 22 shows the exemplary hysteresis control when the correction withdrawal electric power is 40 [W]. With reference to FIG. 22, the maximum instantaneous electric power consumption $P_{max}$ arrives at $P_{limit}$ at the timing $T_{on1}$, and hence the instantaneous electric power consumption suppressing process is started. After that, the maximum instantaneous electric power consumption $P_{max}$ is not more than $P_{limit}$ at the timing $T_h$. However, if the instantaneous electric power consumption suppressing process is withdrawn at the timing $T_h$, then the maximum instantaneous electric power consumption arrives at $P_{limit}$ again, and the instantaneous electric power consumption suppressing process is executed again in some cases. If such a situation arises, the fluctuation of the luminance occurs in a short period of time, which causes the factor to deteriorate the display quality. In view of the above, in this embodiment, the instantaneous electric power consumption suppressing process is started at the timing $T_{on1}$ shown in FIG. 22, and then the instantaneous electric power consumption suppressing process is not withdrawn until the timing $T_{off}$ at which the maximum instantaneous electric power consumption $P_{max}$ arrives at the correction withdrawal electric power.

According to this embodiment, the luminance of the backlight can be suppressed from being frequently fluctuated under the condition in which the maximum instantaneous electric power consumption $P_{max}$ is approximate to the electric power amount $P_{limit}$ capable of being instantaneously supplied, in the backlight in which the instantaneous electric power consumption suppressing process is performed.

The first embodiment to the fifth embodiment are the embodiments of the present invention as having been explained above. However, the present invention is not limited to the embodiments explained above, for which various modifications can be made.

For example, the instantaneous electric power consumption amount is calculated and determined by multiplying the current amount allowed to flow to the respective light sources and the decreased voltage in the forward direction, when the light sources are LEDs. If no means is available to detect the decreased voltage in the forward direction, the decreased voltage may be replaced with a representative value of the decreased voltage in the forward direction of the light source. The instantaneous electric power consumptions, which are calculated as described above, are calculated for all of the light sources (or for the number of light source arrays when the light sources are connected in series), and then they are totalized to obtain a total sum which is used as the instantaneous electric power consumption of the entire backlight.

When the current amount differs for each of the light sources for constructing the backlight, the instantaneous electric power consumption may be calculated by multiplying the current amount which differs for each of the light sources and the decreased voltage in the forward direction, when the instantaneous electric power consumption is calculated.

In the explanation of the respective embodiments, the calculation is performed while fixing the turn-on start timing. However, in view of the moving image response performance, it is sometimes desirable to adopt such a turn-on method that the turn-on end timing is fixed, depending on the characteristic of the liquid crystal display apparatus to be combined with the backlight of the present invention. In the case of the turn-on method as described above, the maximum instantaneous electric power consumption is provided at the turn-on end timing of each of the light source blocks. Therefore, it is also appropriate to calculate the corrected value so that the maximum instantaneous electric power consumption, which is provided at the turn-on end timing of each of the light sources, is not more than the electric power amount capable of being instantaneously supplied.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-065484, filed on Mar. 22, 2012, and Japanese Patent Application No. 2013-015635, filed on Jan. 30, 2013, which are hereby incorporated by reference herein in their entirety.

What is claimed is:

1. A light source control apparatus which controls a plurality of light sources comprising:

a power source which supplies an electric power to the plurality of light sources;

a driver unit configured to successively turn on the plurality of light sources;

a determining unit configured to determine the luminance of each of the plurality of light sources in accordance with an inputted image signal and determines a Pulse Width Modulation (PWM) value relating to a length of a turn-on period within one frame period of each of the plurality of light sources on the basis of the determined luminance;

a calculating unit configured to calculate an electric power consumption of the power source at a start timing or an end timing of the turn-on period of each of the plurality of light sources, which are successively turned on, on the basis of the PWM value determined by the determining unit; and a correcting unit configured to limit, if the electric power consumption calculated by the calculating unit exceeds a predetermined threshold value, the number of light sources which are simultaneously in a lighting state at the start timing or the end timing of the turn-on period of each of the plurality of light sources by shortening the length of the turn-on period of at least one or some of the plurality of light sources so that the electric power consumption does not exceed the threshold value at the start timing or the end timing of the turn-on period of each of the plurality of light sources, which are successively turned on.

2. The light source control apparatus according to claim 1, wherein, if the electric power consumption calculated by the calculating unit exceeds the threshold value, the correcting unit shortens the lengths of the turn-on periods of all of the plurality of light sources.

3. The light source control apparatus according to claim 1, wherein, if the electric power consumption calculated by the calculating unit exceeds the threshold value, the correcting unit does not shorten the length of the turn-on period for the light source among the plurality of light sources which has the highest luminance, and shortens the lengths of the turn-on periods of the other light sources.

4. The light source control apparatus according to claim 1, wherein, if the electric power consumption calculated by the calculating unit exceeds the threshold value, the correcting unit shortens the length of the turn-on period of at least one or some of the plurality of light sources by using a correction coefficient calculated on the basis of a ratio between a maximum value of the electric power consumption calculated by the calculating unit and the threshold value.

5. The light source control apparatus according to claim 1, wherein, if the electric power consumption calculated by the calculating unit exceeds the threshold value, the correcting unit shortens the length of the turn-on period of at least one or some of the plurality of light sources by using a predetermined correction coefficient.

6. A liquid crystal display apparatus comprising:

a backlight having a plurality of light sources and a control apparatus which controls the plurality of light sources; and a liquid crystal display panel which is arranged in front of the backlight and which displays an image by regulating a transmittance of light from the backlight in accordance with the inputted image signal, wherein the control apparatus comprises:

a power source which supplies an electric power to the plurality of light sources;

a driver unit configured to successively turn on the plurality of light sources;

a determining unit configured to determine the luminance of each of the plurality of light sources in accordance with an inputted image signal and determines a Pulse Width Modulation (PWM) value relating to a length of a turn-on period within one frame period of each of the plurality of light sources on the basis of the determined luminance;

a calculating unit configured to calculate an electric power consumption of the power source at a start timing or an end timing of the turn-on period of each of the plurality of light sources, which are successively turned on, on the basis of the PWM value determined by the determining unit; and a correcting unit configured to limit, if the electric power consumption calculated by the calculating unit exceeds a predetermined threshold value, the number of light sources which are simultaneously in a lighting state at the start timing or the end timing of the turn-on period of each of the plurality of light sources by shortening the length of the turn-on period of at least one or some of the plurality of light sources so that the electric power consumption does not exceed the threshold value at the start timing or the end timing of the turn-on period of each of the plurality of light sources, which are successively turned on.

7. The liquid crystal display apparatus according to claim 6, wherein:

the plurality of light sources respectively correspond to a plurality of divided areas which constitute an image display area of the liquid crystal display panel; and the determining unit determines the luminance of the light source corresponding to each of the divided areas in accordance with an image signal corresponding to an image displayed on each of the divided areas.

8. A control method for controlling a light source apparatus which controls a plurality of light sources comprising:

a driving step of successively turning on the plurality of light sources;

a determining step of determining the luminance of each of the plurality of light sources in accordance with an inputted image signal and determining a Pulse Width Modulation (PWM) value relating to a length of a turn-on period within one frame period of each of the plurality of light sources on the basis of the determined luminance;

a calculating step of calculating an electric power consumption of a power source which supplies an electric power to the plurality of light sources, at a start timing or an end timing of the turn-on period of each of the plurality of light sources, which are successively turned on, on the basis of the PWM value determined by the determining unit; and a correcting step of limiting, if the electric power consumption calculated by the calculating unit exceeds a predetermined threshold value, the number of light sources which are simultaneously in a lighting state at the start timing or the end timing of the turn-on period of each of the plurality of light sources by shortening the length of the turn-on period of at least one or some of the plurality of light sources so that the electric power consumption does not exceed the threshold value at the start timing or the end timing of the turn-on period of each of the plurality of light sources, which are successively turned on.

9. A light source apparatus comprising:

a plurality of light sources;

a driver unit configured to successively turn on the plurality of light sources; and a control unit configured to control a Pulse Width Modulation (PWM) value relating to a length of a turn-on period of each of the plurality of light sources in accordance with an inputted image signal, wherein the control unit limits the number of light sources which are simultaneously in a lighting state at a start timing or an end timing of the turn-on period of each of the plurality of light sources by shortening the length of the turn-on period of at least one or some of the plurality of light sources so that the electric power consumption does not exceed a predetermined threshold value at the start timing or the end timing of the turn-on period of each of the plurality of light sources, which are successively turned on.

10. The light source apparatus according to claim 9, wherein the control unit determines the luminance of each of the plurality of light sources in accordance with an inputted image signal and determines the PWM value of each of the plurality of light sources on the basis of the determined luminance.

11. The light source apparatus according to claim 9, wherein the control unit determines the PWM value of each of the plurality of light sources so that the number of light sources which are simultaneously in a lighting state at the start timing or the end timing of the turn-on period of each of the plurality of light sources.

12. A liquid crystal display apparatus comprising:

a backlight having a plurality of light sources and a control apparatus which controls the plurality of light sources; and a liquid crystal display panel which is arranged in front of the backlight and which displays an image by regulating a transmittance of light from the backlight in accordance with the inputted image signal, wherein the control apparatus comprises:

a driver unit configured to successively turn on the plurality of light sources; and a control unit configured to control a Pulse Width Modulation (PWM) value relating to a length of a turn-on period of each of the plurality of light sources in accordance with an inputted image signal, wherein the control unit limits the number of light sources which are simultaneously in a lighting state at a start timing or an end timing of the turn-on period of each of the plurality of light sources by shortening the length of the turn-on period of at least one or some of the plurality of light sources so that the electric power consumption does not exceed a predetermined threshold value at the start timing or the end timing of the turn-on period of each of the plurality of light sources, which are successively turned on.

13. A control method for controlling a light source apparatus comprising a plurality of light sources comprising:

successively turning on the plurality of light sources;

controlling a Pulse Width Modulation (PWM) value relating to a length of a turn-on period of each of the plurality of light sources in accordance with an inputted image signal; and limiting the number of light sources which are simultaneously in a lighting state at a start timing or an end timing of the turn-on period of each of the plurality of light sources by shortening the length of the turn-on period of at least one or some of the plurality of light sources so that the electric power consumption does not exceed a predetermined threshold value at the start timing or the end timing of the turn-on period of each of the plurality of light sources, which are successively turned on.

14. A light source apparatus comprising:

a plurality of light sources;

a driver unit configured to successively turn on the plurality of light sources; and a control unit configured to control a Pulse Width Modulation (PWM) value relating to a length of a turn-on period of each of the plurality of light sources in accordance with an inputted image signal, wherein the control unit limits the number of light sources among the plurality of light sources which are simultaneously in a lighting state by shortening the length of the turn-on period of at least one or some of the plurality of light sources so that the electric power consumption of the plurality of light sources does not exceed a predetermined threshold value.

15. The light source apparatus according to claim 14, wherein the control unit determines the luminance of each of the plurality of light sources in accordance with an inputted image signal and determines the PWM value of each of the plurality of light sources on the basis of the determined luminance.

16. The light source apparatus according to claim 14, wherein the control unit determines the PWM value of each of the plurality of light sources so that the electric power consumption of the plurality of light sources does not exceed the predetermined threshold value at a start timing of the turn-on period of each of the plurality of light sources.

17. The light source apparatus according to claim 14, wherein the control unit determines the PWM value of each of the plurality of light sources so that the electric power consumption of the plurality of light sources does not exceed the predetermined threshold value at an end timing of the turn-on period of each of the plurality of light sources.

18. The light source apparatus according to claim 14, wherein, if the electric power consumption of the plurality of light sources exceeds the threshold value, the control unit shortens the lengths of the turn-on periods of all of the plurality of light sources.

19. The light source apparatus according to claim 14, wherein, if the electric power consumption of the plurality of light sources exceeds the threshold value, the control unit does not shorten the length of the turn-on period for the light source among the plurality of light sources which has the highest luminance, and shortens the lengths of the turn-on periods of the other light sources.

20. The light source apparatus according to claim 14, wherein, if the electric power consumption of the plurality of light sources exceeds the threshold value, the control unit shortens the length of the turn-on period of at least one or some of the plurality of light sources by using a correction coefficient calculated on the basis of a ratio between a maximum value of the electric power consumption of the plurality of light sources and the threshold value.

21. The light source apparatus according to claim 14, wherein, if the electric power consumption of the plurality of light sources exceeds the threshold value, the control unit shortens the length of the turn-on period of at least one or some of the plurality of light sources by using a predetermined correction coefficient.

22. A liquid crystal display apparatus comprising:

a backlight having a plurality of light sources and a control apparatus which controls the plurality of light sources; and a liquid crystal display panel which is arranged in front of the backlight and which displays an image by regulating a transmittance of light from the backlight in accordance with the inputted image signal, wherein the control apparatus comprises:

a driver unit configured to successively turn on the plurality of light sources; and a control unit configured to control a Pulse Width Modulation (PWM) value relating to a length of a turn-on period of each of the plurality of light sources in accordance with an inputted image signal, wherein the control unit limits the number of light sources among the plurality of light sources which are simultaneously in a lighting state by shortening the length of the turn-on period of at least one or some of the plurality of light sources so that the electric power consumption of the plurality of light sources does not exceed a predetermined threshold value.

23. The liquid crystal display apparatus according to claim 22, wherein:

the plurality of light sources respectively correspond to a plurality of divided areas which constitute an image display area of the liquid crystal display panel; and the control unit determines the luminance of the light source corresponding to each of the divided areas in accordance with an image signal corresponding to an image displayed on each of the divided areas.

24. A control method for controlling a light source apparatus comprising a plurality of light sources comprising:

successively turning on the plurality of light sources;

controlling a Pulse Width Modulation (PWM) value relating to a length of a turn-on period of each of the plurality of light sources in accordance with an inputted image signal; and limiting the number of light sources among the plurality of light sources which are simultaneously in a lighting state by shortening the length of the turn-on period of at least one or some of the plurality of light sources so that the electric power consumption of the plurality of light sources does not exceed a predetermined threshold value.

* * * * *